US009642403B2

(12) United States Patent
Welch et al.

(10) Patent No.: US 9,642,403 B2
(45) **Date of Patent: *May 9, 2017**

(54) STRAP FASTENING SYSTEM FOR A DISPOSABLE RESPIRATOR PROVIDING IMPROVED DONNING

(75) Inventors: Debra N. Welch, Woodstock, GA (US); Eric C. Steindorf, Roswell, GA (US); Shawn R. Feaster, Waunakee, WI (US); Theresa Michelle McCoy, Cumming, GA (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 1287 days.

This patent is subject to a terminal disclaimer.

(21) Appl. No.: 12/075,110

(22) Filed: Mar. 7, 2008

(65) Prior Publication Data

US 2009/0044812 A1 Feb. 19, 2009

Related U.S. Application Data

(63) Continuation-in-part of application No. 11/840,031, filed on Aug. 16, 2007.

(51) Int. Cl.

| | |
|---|---|
| ***A41D 13/11*** | (2006.01) |
| ***A62B 23/02*** | (2006.01) |
| ***A62B 18/08*** | (2006.01) |

(52) U.S. Cl.

CPC ..... *A41D 13/1161* (2013.01); *A62B 18/084* (2013.01); *A62B 23/025* (2013.01)

(58) Field of Classification Search

CPC ..... A61M 16/06–16/0655; A61M 16/0683

USPC ..... 128/205.25, 205.27, 206.12, 206.13, 128/206.16, 206.19, 206.21, 206.27, 128/206.28, 207.11, 207.12

See application file for complete search history.

(56) References Cited

U.S. PATENT DOCUMENTS

| | | | |
|---|---|---|---|
| 2,640,481 | A | 6/1953 | Conley |
| 2,751,904 | A | 6/1956 | Lewis |
| 2,858,828 | A | 11/1958 | Matheson |
| 2,998,818 | A | 9/1961 | Tabor et al. |
| 3,154,073 | A | 10/1964 | Klinger |
| 3,249,108 | A | 5/1966 | Terman |
| 3,308,816 | A | 3/1967 | Franklin et al. |
| 3,338,992 | A | 8/1967 | Kinney |

(Continued)

FOREIGN PATENT DOCUMENTS

| | | | |
|---|---|---|---|
| CA | 1213496 | A | 11/1986 |
| CA | 1280851 | C | 3/1991 |

(Continued)

OTHER PUBLICATIONS

First Office Action received in Japanese Patent Application No. 2010-520649 mailed Nov. 6, 2012.

(Continued)

*Primary Examiner* — LaToya M Louis

(74) *Attorney, Agent, or Firm* — Armstrong Teasdale LLP

(57) ABSTRACT

A disposable respirator has a strap fastening system that facilitates ease of donning and comfort during wear. More specifically, the respirator includes a pull-strap fastening component and a strap configuration that provides a tight seal over the mouth and nose of the user, yet be easily donned and comfortable to wear.

7 Claims, 7 Drawing Sheets

(56) References Cited

U.S. PATENT DOCUMENTS 3,341,394 A 9/1967 Kinney
3,491,755 A 1/1970 Barghini et al.
3,494,821 A 2/1970 Evans
3,502,763 A 3/1970 Hartmann
3,542,615 A 11/1970 Dobo et al.
3,692,618 A 9/1972 Dorschner et al.
3,779,244 A 12/1973 Weeks, Jr. et al.
3,802,817 A 4/1974 Matsuki et al.
3,849,241 A 11/1974 Butin et al.
3,861,381 A 1/1975 Witman et al.
4,041,203 A 8/1977 Brock et al.
4,100,324 A 7/1978 Anderson et al.
4,144,370 A 3/1979 Boulton
4,155,358 A 5/1979 McAllister et al.
4,209,563 A 6/1980 Sisson
4,296,746 A 10/1981 Mason, Jr. et al.
4,323,534 A 4/1982 Desmarais
4,340,563 A 7/1982 Appel et al.
4,374,888 A 2/1983 Bornslaeger
D271,246 S 11/1983 Matheson et al.
4,414,973 A 11/1983 Matheson et al.
4,443,513 A 4/1984 Meitner et al.
4,536,440 A 8/1985 Berg
4,549,543 A 10/1985 Moon
4,592,350 A 6/1986 Maryyanek et al.
4,600,002 A 7/1986 Maryyanek et al.
4,631,933 A 12/1986 Carey, Jr.
4,652,487 A 3/1987 Morman
4,655,760 A 4/1987 Morman et al.
4,657,010 A 4/1987 Wright
4,657,802 A 4/1987 Morman
4,663,220 A 5/1987 Wisneski et al.
4,720,415 A 1/1988 Vander Wielen et al.
4,723,542 A 2/1988 Giffard
4,741,949 A 5/1988 Morman et al.
4,766,029 A 8/1988 Brock et al.
4,781,966 A 11/1988 Taylor
4,787,699 A 11/1988 Moulin
4,789,699 A 12/1988 Kieffer et al.
4,789,802 A 12/1988 Miyake
4,803,117 A 2/1989 Daponte
4,807,619 A 2/1989 Dyrud et al.
4,827,924 A 5/1989 Japuntich
4,834,738 A 5/1989 Kielpikowski et al.
4,856,508 A 8/1989 Tayebi
4,873,972 A 10/1989 Magidson et al.
4,883,547 A 11/1989 Japuntich
4,891,957 A 1/1990 Strack et al.
4,937,299 A 6/1990 Ewen et al.
4,951,664 A 8/1990 Niemeyer
4,965,122 A 10/1990 Morman
4,974,586 A 12/1990 Wandel et al.
4,981,134 A 1/1991 Courtney
4,981,747 A 1/1991 Morman
5,042,473 A 8/1991 Lewis
5,057,368 A 10/1991 Largman et al.
5,062,421 A 11/1991 Burns et al.
5,069,970 A 12/1991 Largman et al.
5,080,094 A 1/1992 Tayebi
5,093,422 A 3/1992 Himes
5,094,236 A 3/1992 Tayebi
D326,540 S 5/1992 Scholey
5,114,781 A 5/1992 Morman
5,162,074 A 11/1992 Hills
5,169,706 A 12/1992 Collier, IV et al.
5,181,280 A 1/1993 Zachry, Jr.
5,181,507 A 1/1993 Michel et al.
5,213,881 A 5/1993 Timmons et al.
5,218,071 A 6/1993 Tsutsui et al.
5,226,992 A 7/1993 Morman
5,244,482 A 9/1993 Hassenboehler, Jr. et al.
5,272,236 A 12/1993 Lai et al.
5,277,976 A 1/1994 Hogle et al.
5,278,272 A 1/1994 Lai et al.
5,284,703 A 2/1994 Everhart et al.
5,304,599 A 4/1994 Himes
D347,298 S 5/1994 Japuntich et al.
D347,299 S 5/1994 Bryant et al.
5,322,061 A 6/1994 Brunson
5,322,728 A 6/1994 Davey et al.
5,325,892 A 7/1994 Japuntich et al.
5,331,957 A 7/1994 Liu
5,332,613 A 7/1994 Taylor et al.
5,336,545 A 8/1994 Morman
5,350,624 A 9/1994 Georger et al.
5,353,789 A 10/1994 Schlobohm
5,401,466 A 3/1995 Foltz et al.
5,419,318 A 5/1995 Tayebi
5,431,158 A * 7/1995 Tirotta ..... 128/206.21
5,464,010 A 11/1995 Byram
5,464,688 A 11/1995 Timmons et al.
5,466,410 A 11/1995 Hills
5,472,775 A 12/1995 Obijeski et al.
5,539,056 A 7/1996 Yang et al.
5,571,619 A 11/1996 McAlpin et al.
5,596,052 A 1/1997 Resconi et al.
5,647,357 A 7/1997 Barnett et al.
5,660,174 A 8/1997 Jacobelli
D389,239 S 1/1998 Scholey
5,711,036 A * 1/1998 Kita et al. ..... 2/452
5,720,281 A 2/1998 Allen et al.
5,732,695 A 3/1998 Metzger
5,848,589 A 12/1998 Welnetz
5,906,033 A 5/1999 Mukaiyama
D413,166 S 8/1999 Snow et al.
5,932,497 A 8/1999 Morman et al.
5,932,981 A 8/1999 Vrionis
5,996,581 A * 12/1999 Duch ..... 128/206.26
6,015,764 A 1/2000 McCormack et al.
6,016,804 A 1/2000 Gleason et al.
6,041,782 A 3/2000 Angadjivand et al.
6,055,982 A * 5/2000 Brunson et al. ..... 128/206.12
6,062,222 A 5/2000 Lewis et al.
6,070,579 A 6/2000 Bryant et al.
6,090,325 A 7/2000 Wheat et al.
6,111,163 A 8/2000 McCormack et al.
D431,647 S 10/2000 Henderson et al.
6,125,849 A 10/2000 Williams et al.
D434,493 S 11/2000 Fecteau et al.
6,148,817 A 11/2000 Bryant et al.
6,315,864 B2 11/2001 Anderson et al.
6,332,465 B1 12/2001 Xue et al.
D452,911 S 1/2002 Danielsson
6,371,110 B1 4/2002 Peterson et al.
6,394,090 B1 5/2002 Chen et al.
6,418,929 B1 7/2002 Norfleet
6,435,881 B1 8/2002 Zein et al.
6,461,457 B1 10/2002 Taylor et al.
6,484,722 B2 11/2002 Bostock et al.
6,500,563 B1 12/2002 Datta et al.
D471,627 S 3/2003 Mittelstadt et al.
6,536,434 B1 3/2003 Bostock et al.
6,536,853 B2 3/2003 Egle et al.
D473,299 S 4/2003 Fecteau et al.
6,550,070 B2 4/2003 Wiegand
6,571,797 B1 6/2003 Magidson et al.
6,584,975 B1 7/2003 Taylor
6,745,404 B2 6/2004 Chen Lieh
6,776,161 B2 8/2004 Horn
D497,667 S 10/2004 Odell et al.
6,805,124 B2 10/2004 Japuntich et al.
6,817,362 B2 11/2004 Gélinas et al.
6,874,499 B2 4/2005 Viner et al.
6,883,518 B2 4/2005 Mittelstadt et al.
D504,947 S 5/2005 McAuley et al.
6,886,563 B2 5/2005 Bostock et al.
6,916,750 B2 7/2005 Thomas et al.
6,936,019 B2 8/2005 Mason
6,959,709 B2 11/2005 Curran et al.
7,066,179 B2 6/2006 Eaton et al.
7,082,622 B1 8/2006 Olander
D528,653 S 9/2006 Matthew et al.
7,185,653 B2 3/2007 Lee
D542,407 S 5/2007 Stallard et al.

(56) References Cited

U.S. PATENT DOCUMENTS

| | | | |
|---|---|---|---|
| 7,219,669 | B1 | 5/2007 | Lovell et al. |
| D563,546 | S | 3/2008 | Luila et al. |
| D577,816 | S | 9/2008 | Ungar |
| D583,929 | S | 12/2008 | Reusch |
| D604,834 | S | 11/2009 | Ungar |
| D609,803 | S | 2/2010 | Ungar |
| 7,762,254 | B2 | 7/2010 | Ho |
| 2002/0195109 | A1 | 12/2002 | Mittelstadt et al. |
| 2003/0024533 | A1 | 2/2003 | Sniadach |
| 2003/0154984 | A1 | 8/2003 | Fernandes |
| 2004/0065328 | A1* | 4/2004 | Amarasinghe et al. . 128/206.27 |
| 2004/0084048 | A1 | 5/2004 | Stenzler et al. |
| 2004/0121687 | A1 | 6/2004 | Morman et al. |
| 2004/0237962 | A1 | 12/2004 | Russell |
| 2004/0244798 | A1 | 12/2004 | Lin |
| 2005/0056286 | A1 | 3/2005 | Huddart et al. |
| 2005/0061327 | A1 | 3/2005 | Martin et al. |
| 2005/0098183 | A1 | 5/2005 | Nash et al. |
| 2005/0114986 | A1 | 6/2005 | Hobart |
| 2005/0139216 | A1 | 6/2005 | Mittelstadt et al. |
| 2005/0211251 | A1 | 9/2005 | Henderson et al. |
| 2006/0225740 | A1 | 10/2006 | Eaton et al. |
| 2006/0249159 | A1 | 11/2006 | Ho et al. |
| 2007/0044802 | A1 | 3/2007 | Horne et al. |
| 2007/0044803 | A1 | 3/2007 | Xue et al. |
| 2007/0251522 | A1 | 11/2007 | Welchel et al. |
| 2007/0252946 | A1 | 11/2007 | Welchel et al. |
| 2008/0110465 | A1 | 5/2008 | Welchel et al. |
| 2009/0044811 | A1 | 2/2009 | Welchel et al. |
| 2010/0224199 | A1 | 9/2010 | Smith et al. |

FOREIGN PATENT DOCUMENTS

| | | | |
|---|---|---|---|
| CA | 2306828 | A1 | 5/1999 |
| CA | 2448219 | A1 | 1/2003 |
| CA | 2449252 | A1 | 1/2003 |
| CA | 2456216 | A1 | 2/2003 |
| CA | 2067195 | C | 6/2003 |
| CA | 2497402 | A1 | 4/2004 |
| CA | 108341 | | 2/2006 |
| CA | 2248176 | C | 4/2006 |
| DE | 1 077 067 | B | 3/1960 |
| DE | 1077067 | B | 3/1960 |
| DE | 1 245 744 | B | 7/1967 |
| DE | 199 62 515 | A1 | 7/2001 |
| EM | 000225610.0001 | | 12/2004 |
| EM | 000380753.0002 | | 11/2005 |
| EM | 000588314.0001 | | 2/2007 |
| EM | 000588314.0003 | | 2/2007 |
| EP | 0 109 514 | A1 | 5/1984 |
| EP | 0 234 746 | A1 | 9/1987 |
| EP | 0 196 953 | B1 | 10/1989 |
| EP | 0 281 275 | B1 | 11/1994 |
| EP | 0 543 174 | B1 | 3/1996 |
| EP | 0 884 959 | B1 | 12/2000 |
| EP | 1 014 816 | B1 | 12/2002 |
| EP | 1 285 594 | A2 | 2/2003 |
| EP | 1 224 011 | B1 | 11/2005 |
| EP | 1 647 311 | A1 | 4/2006 |
| FR | 848526 | A | 10/1939 |
| GB | 2059782 | | 4/1981 |
| GB | 2 076 966 | A | 12/1981 |
| GB | 2092009 | | 8/1982 |
| GB | 2 397 244 | A | 7/2004 |
| JP | S33-11700 | | 8/1958 |
| JP | 53-153700 | | 5/1977 |
| JP | HEI 53153700 | * | 5/1977 |
| JP | S59-048654 | | 3/1984 |
| JP | H06048697 | U | 7/1994 |
| JP | H7-25968 | | 6/1995 |
| JP | H8-004033 | | 2/1996 |
| JP | 10201866 | | 8/1998 |
| JP | H11-290473 | | 10/1999 |
| WO | 8601734 | | 3/1986 |
| WO | WO 91/05584 | A1 | 5/1991 |
| WO | WO 97/32494 | A1 | 9/1997 |
| WO | WO 98/58558 | A1 | 12/1998 |
| WO | WO 99/06116 | A1 | 2/1999 |
| WO | WO 99/21618 | A1 | 5/1999 |
| WO | WO 01/28634 | A1 | 4/2001 |
| WO | 01/66194 | A1 | 9/2001 |
| WO | WO 01/66194 | A1 | 9/2001 |
| WO | WO 03/000347 | A1 | 1/2003 |
| WO | WO 03/001097 | A1 | 1/2003 |
| WO | WO 03/013657 | A1 | 2/2003 |
| WO | WO 03/018136 | A1 | 3/2003 |
| WO | WO 2004/026408 | A1 | 4/2004 |
| WO | WO 2005/099826 | A1 | 10/2005 |
| WO | 2007/125487 | A1 | 11/2007 |
| WO | 2007/125499 | A2 | 11/2007 |

OTHER PUBLICATIONS

Extended European Search Report EP 08789480.4 dated May 6, 2013; 7 pages.

International Search Report and Written Opinion for PCT/IB2008/053039 dated Feb. 20, 2009; 8 pages.

* cited by examiner

STRAP FASTENING SYSTEM FOR A DISPOSABLE RESPIRATOR PROVIDING IMPROVED DONNING

This application is a continuation-in-part of application Ser. No. 11/840,031, filed on 16 Aug. 2007.

BACKGROUND OF DISCLOSURE

The present disclosure generally relates to a disposable respirator comprising a strap fastening system that facilitates ease of donning and comfort during wear. More specifically, the respirator comprises a strap fastening system that is configured to provide a tight seal over the mouth and nose of the user, yet be easily donned and comfortable to wear.

Respirators find utility in a variety of manufacturing, custodial, sporting, and household applications. In these applications, respirators filter out dust and other contaminates that may be harmful or unpleasant to the user. Likewise, respirators have found utility in the healthcare industry. In this regard, respirators also filter inhaled air to protect the user from contaminants that may be found in a hospital setting, as hospital patients commonly carry airborne bacterial pathogens. Respirators have thus been designed to provide for a tight sealing arrangement over the mouth and nose of the user. Such a sealing arrangement may prove useful in preventing the transfer of pathogens that reside in bodily fluids or other liquids. As such, respirators have been designed in order to prevent airborne pathogens and/or pathogens in fluids from being transferred to and/or from the health care provider. Such sealing arrangements can also be used to help keep out dust, particles, or other contaminants from air being inhaled by the user.

Attached to the respirator is a securing device that is used for attaching the front panel (i.e., main body of the respirator) to the head of the user. Currently, disposable respirators, especially those used for industrial or related purposes, typically incorporate two thin elastic bands (i.e., straps) that are intended to span the back and top of the user's head to ensure a close and tight fit. For this purpose, the respirator is placed on the face of the user and the straps are extended around the head of the user, thus, fastening the respirator to the user.

One particular problem with the currently used elastic bands/straps is that these straps are difficult to place correctly over the head and frequently slide, roll, or slip out of place. These straps are generally narrow which results in discomfort due to the pressure of the straps pressing the skin during use. In some designs the straps are of set length and rely on the elastic properties of the strap material to provide the necessary force to seal the respirator to the face of the user. In other designs, buckles, clips, or some other means of adjusting the strap length is incorporated.

As such, there is a need for a respirator configured to include an adjustable or elastic strap and fastening components that facilitates ease of donning and comfort during wear.

SUMMARY OF THE DISCLOSURE

It has been found that disposable respirators can be configured to provide for easier donning and more comfortable wear. Specifically, a respirator having one or more straps configured to provide for easier donning and a more comfortable wear can be provided by using a strap comprising one or more pull-strap fastening components that are attached with the main body of the respirator. In addition, if a wider, lower tension strap is used with such a configuration, the pressure on the user's head and skin produced by the strap is reduced, allowing for a more comfortable wear to the user, while still allowing for a sufficiently tight seal of the respirator over the mouth and nose of the user. These fastening systems (e.g., made up of the pull-strap fastening components and fastening components) may also provide a means of adjusting the length of the straps.

As such, the present disclosure is directed to a respirator including a main body adapted to cover the mouth and nose of a user of the respirator; the main body having a first side of the main body and a second opposing side of the main body. The respirator further includes a first pull-strap fastening component and a second pull-strap fastening component, the first pull-strap fastening component being attached with the first side of the main body and the second pull-strap fastening component being attached with the second side of the main body. The first pull-strap and the second pull-strap fastening components independently comprise a first slot and a second slot, the second slot being located laterally closer to the user's ear than the first slot. A strap is connected to the first pull-strap fastening component and the second pull-strap fastening component, such that the second pull-strap fastening component includes an adjustment member that can be adjusted to fit the respirator to the user's head and the strap encircles the user's head by being adjustably looped through the first pull-strap fastening component between ends of the strap and both ends extend back around the user's head to the second pull-strap fastening component where both ends of the strap are adjustably threaded through the second pull-strap fastening component.

The present disclosure is also directed to an embodiment of a respirator including a main body adapted to cover the mouth and nose of a user of the respirator; the main body having a first side of the main body and a second opposing side of the main body. Such respirator further includes a first pull-strap fastening component and a second pull-strap fastening component, the first pull-strap fastening component being attached with the first side of the main body and the second pull-strap fastening component being attached with the second side of the main body. The first pull-strap and the second pull-strap fastening components independently each have a first slot and a second slot, the second slot being located laterally closer to the user's ear than the first slot. A strap is connected to the first pull-strap fastening component and the second pull-strap fastening component, such that the second pull-strap fastening component is an adjustment member that can be adjusted to fit the respirator to the user's head and the strap encircles the user's head by being adjustably looped through the first pull-strap fastening component between ends of the strap and both ends extend back around the user's head to the second pull-strap fastening component where both ends of the strap are adjustably threaded through the second pull-strap fastening component. Further, the strap is a single continuous strap with a first portion located over the user's ear and about an upper area of the user's head and a second portion located under the user's ear and about a lower area of the user's head and at least some portion of the strap has a width of from about 0.3 cm to about 5 cm.

Other objects and features will be in part apparent and in part pointed out hereinafter.

BRIEF DESCRIPTION OF THE DRAWINGS

Corresponding reference characters indicate corresponding parts throughout the drawings.

DEFINITIONS

Figure 1:
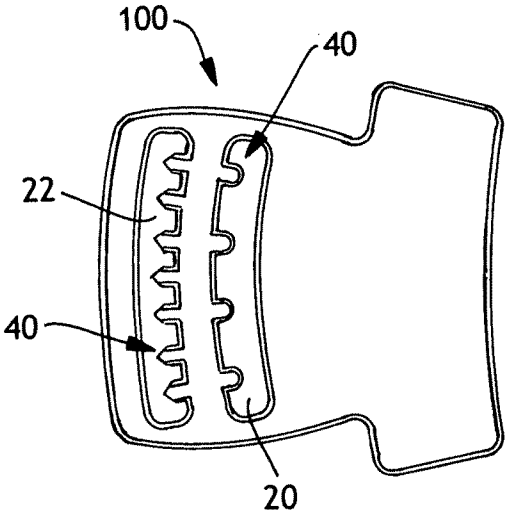
FIG. 1 is a top view of a first representative embodiment of a fastening system of the present disclosure.
Figure 2:
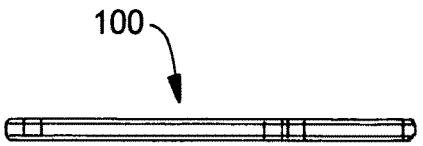
FIG. 2 is a side view of the embodiment of a fastening system seen in FIG. 1.
Figure 3:
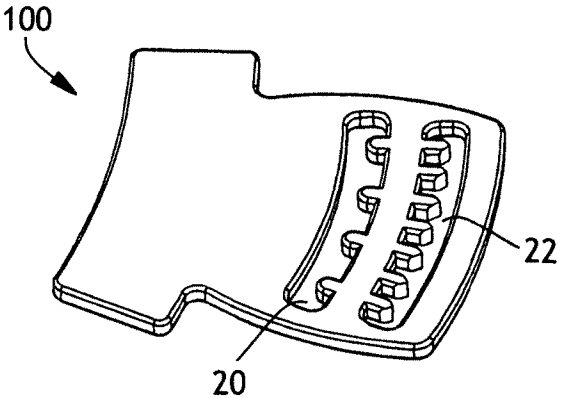
FIG. 3 is a top perspective view of the fastening system of FIG. 2.
Figure 4:
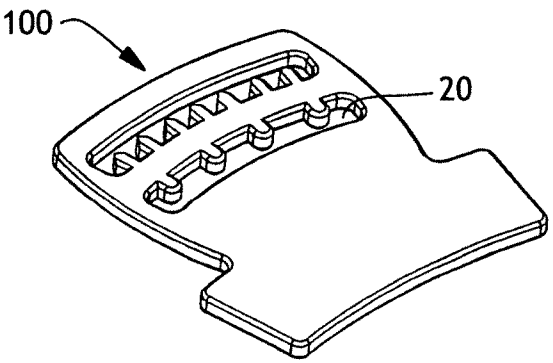
FIG. 4 is a bottom perspective view of embodiment of a fastening system seen in FIG. 1.

Within the context of this specification, each term or phrase below includes the following meaning or meanings:

"Attach" and its derivatives refer to the joining, adhering, connecting, bonding, sewing together, or the like, of two elements. Two elements will be considered to be attached together when they are integral with one another or attached directly to one another or indirectly to one another, such as when each is directly attached to intermediate elements. "Attach" and its derivatives include permanent, releasable, or refastenable attachment. In addition, the attachment can be completed either during the manufacturing process or by the end user.

"Autogenous bonding" and its derivatives refer to bonding provided by fusion and/or self-adhesion of fibers and/or filaments without an applied external adhesive or bonding agent. Autogenous bonding may be provided by contact between fibers and/or filaments while at least a portion of the fibers and/or filaments are semi-molten or tacky. Autogenous bonding may also be provided by blending a tackifying resin with the thermoplastic polymers used to form the fibers and/or filaments. Fibers and/or filaments formed from such a blend can be adapted to self-bond with or without the application of pressure and/or heat. Solvents may also be used to cause fusion of fibers and filaments which remains after the solvent is removed.

"Bond," "interbond," and their derivatives refer to the joining, adhering, connecting, attaching, sewing together, or the like, of two elements. Two elements will be considered to be bonded or interbonded together when they are bonded directly to one another or indirectly to one another, such as when each is directly bonded to intermediate elements. "Bond" and its derivatives include permanent, releasable, or refastenable bonding. "Autogenous bonding," as described above, is a type of "bonding."

"Connect" and its derivatives refer to the joining, adhering, bonding, attaching, sewing together, or the like, of two elements. Two elements will be considered to be connected together when they are connected directly to one another or indirectly to one another, such as when each is directly connected to intermediate elements. "Connect" and its derivatives include permanent, releasable, or refastenable connection. In addition, the connecting can be completed either during the manufacturing process or by the end user.

"Disposable" refers to articles that are designed to be discarded after a limited use rather than being restored for reuse.

The terms "disposed on," "disposed along," "disposed with," or "disposed toward" and variations thereof are intended to mean that one element can be integral with another element, or that one element can be a separate structure bonded to or placed with or placed near another element.

"Layer" when used in the singular can have the dual meaning of a single element or a plurality of elements.

"Machine direction" or "MD" generally refers to the direction in which a material is produced. The terms "cross-machine direction", "cross-direction", or "CD" refers to the direction perpendicular to the machine direction.

"Nonwoven" and "nonwoven web" refer to materials and webs of material that are formed without the aid of a textile weaving or knitting process. For example, nonwoven materials, fabrics or webs have been formed from many processes such as, for example, meltblowing processes, spunbonding processes, air laying processes, coform processes, and bonded carded web processes.

"Operatively connected" refers to the communication pathway by which one element, such as a sensor, communicates with another element, such as an information device. Communication may occur by way of an electrical connection through a conductive wire. Or communication may occur via a transmitted signal such as an infrared frequency, a radio frequency, or some other transmitted frequency signal. Alternatively, communication may occur by way of a mechanical connection, such as a hydraulic or pneumatic connection.

"Spunbonded fibers" refers to small diameter fibers which are formed by extruding molten thermoplastic material as filaments from a plurality of fine, usually circular capillaries of a spinneret with the diameter of the extruded filaments then being rapidly reduced to fibers as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, and U.S. Pat. No. 3,542,615 to Dobo et al., the contents of which are incorporated herein by reference in their entirety. Spunbond fibers are generally continuous and have diameters generally greater than about 7 microns, more particularly, between about 10 and about 20 microns.

"Stretch bonded laminate" refers to a composite material having at least two layers in which one layer is a gatherable layer and the other layer is an elastic layer. The layers are joined together when the elastic layer is extended from its original condition so that upon relaxing the layers, the gatherable layer is gathered. Such a multilayer composite elastic material may be stretched to the extent that the non-elastic material gathered between the bond locations allows the elastic material to elongate. One type of stretch bonded laminate is disclosed, for example, by U.S. Pat. No. 4,720,415 to Vander Wielen et al., the content of which is incorporated herein by reference in its entirety. Other composite elastic materials are disclosed in U.S. Pat. No. 4,789,699 to Kieffer et al., U.S. Pat. No. 4,781,966 to Taylor and U.S. Pat. Nos. 4,657,802 and 4,652,487 to Morman and U.S. Pat. No. 4,655,760 to Morman et al., the contents of which are incorporated herein by reference in their entirety.

"Vertical filament laminate" refers to a composite material having at least two layers in which one layer is a gatherable layer and the other layer is an elastic layer. The layers are joined together when the elastic layer is extended from its original condition so that upon relaxing the layers, the gatherable layer is gathered. As with the "stretch bonded laminate" above, such a multilayer composite elastic material may be stretched to the extent that the non-elastic material gathered between the bond locations allows the elastic material to elongate. One type of vertical filament laminate is disclosed, for example, by U.S. Pat. No. 6,916,750 to Thomas et al., the content of which is incorporated herein by reference in its entirety.

"Necking" or "neck stretching" interchangeably refer to a method of elongating a nonwoven fabric, generally in the machine direction, to reduce its width (cross-machine direction) in a controlled manner to a desired amount. The controlled stretching may take place under cool, room temperature or greater temperatures and is limited to an increase in overall dimension in the direction being stretched up to the elongation required to break the fabric, which in most cases is about 1.2 to 1.6 times. When relaxed, the web retracts toward, but does not return to, its original dimensions. Such a process is disclosed, for example, in U.S. Pat. No. 4,443,513 to Meitner and Notheis, U.S. Pat. Nos. 4,965,122, 4,981,747 and 5,114,781 to Morman and U.S. Pat. No. 5,244,482 to Hassenboehier Jr. et al., the contents of which are incorporated herein by reference in their entirety.

"Necked material" refers to any material which has undergone a necking or neck stretching process.

"Reversibly necked material" refers to a material that possesses stretch and recovery characteristics formed by necking a material, then heating the necked material, and cooling the material. Such a process is disclosed in U.S. Pat. No. 4,965,122 to Morman, and incorporated by reference herein in its entirety. As used herein, the term "neck bonded laminate" refers to a composite material having at least two layers in which one layer is a necked, non-elastic layer and the other layer is an elastic layer. The layers are joined together when the non-elastic layer is in an extended (necked) condition. Examples of neck-bonded laminates are such as those described in U.S. Pat. Nos. 5,226,992, 4,981,747, 4,965,122 and 5,336,545 to Morman, the contents of which are incorporated herein by reference in their entirety.

"Ultrasonic bonding" refers to a process in which materials (fibers, webs, films, etc.) are joined by passing the materials between a sonic horn and anvil roll. An example of such a process is illustrated in U.S. Pat. No. 4,374,888 to Bornslaeger, the content of which is incorporated herein by reference in its entirety.

"Thermal point bonding" involves passing materials (fibers, webs, films, etc.) to be bonded between a heated calendar roll and an anvil roll. The calendar roll is usually, though not always, patterned in some way so that the entire fabric is not bonded across its entire surface, and the anvil roll is usually flat. As a result, various patterns for calendar rolls have been developed for functional as well as aesthetic reasons. Typically, the percent bonding area varies from around 10 percent to around 30 percent of the area of the fabric laminate. As is well known in the art, thermal point bonding holds the laminate layers together and imparts integrity to each individual layer by bonding filaments and/or fibers within each layer.

"Elastic" refers to any material, including a film, fiber, nonwoven web, or combination thereof, which upon application of a biasing force in at least one direction, is stretchable to a stretched, biased length which is at least about 110 percent, suitably at least about 130 percent, and particularly at least about 150 percent, its relaxed, unstretched length, and which will recover at least 15 percent of its elongation upon release of the stretching, biasing force. In the present application, a material need only possess these properties in at least one direction to be defined as elastic.

"Extensible and retractable" refers to the ability of a material to extend upon stretch and retract upon release. Extensible and retractable materials are those which, upon application of a biasing force, are stretchable to a stretched, biased length and which will recover a portion, preferably at least about 15 percent, of their elongation upon release of the stretching, biasing force.

As used herein, the terms "elastomer" or "elastomeric" refer to polymeric materials that have properties of stretchability and recovery.

"Stretch" refers to the ability of a material to extend upon application of a biasing force. Percent stretch is the difference between the initial dimension of a material and that same dimension after the material has been stretched or extended following the application of a biasing force. Percent stretch may be expressed as [(stretched length−initial sample length)/initial sample length]×100. For example, if a material having an initial length of one (1) inch is stretched 0.50 inch, that is, to an extended length of 1.50 inches, the material can be said to have a stretch of 50 percent.

"Recover" or "recovery" refers to a contraction of a stretched material upon termination of a biasing force following stretching of the material by application of the biasing force. For example, if a material having a relaxed, unbiased length of one (1) inch is elongated 50 percent by stretching to a length of one and one half (1.5) inches the material would have a stretched length that is 150 percent of its relaxed length. If this exemplary stretched material contracted, that is recovered to a length of one and one tenth (1.1) inches after release of the biasing and stretching force, the material would have recovered 80 percent (0.4 inch) of its elongation.

"Polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries. These terms may be defined with additional language in the remaining portions of the specification.

DETAILED DESCRIPTION OF THE DISCLOSURE

The present disclosure is directed to a respirator comprising straps, pull-strap fastening components and fastening systems configured to provide ease of donning and comfortable wear. Specifically, one aspect of the present disclosure is directed to a respirator comprising: a main body adapted to cover the mouth and nose of a user of the respirator; a first pull-strap fastening component attached with the first side of the main body and a second pull-strap fastening component attached with the second side of the main body; and a strap connected to the first pull-strap fastening component and the second pull-strap fastening component.

Figure 5:
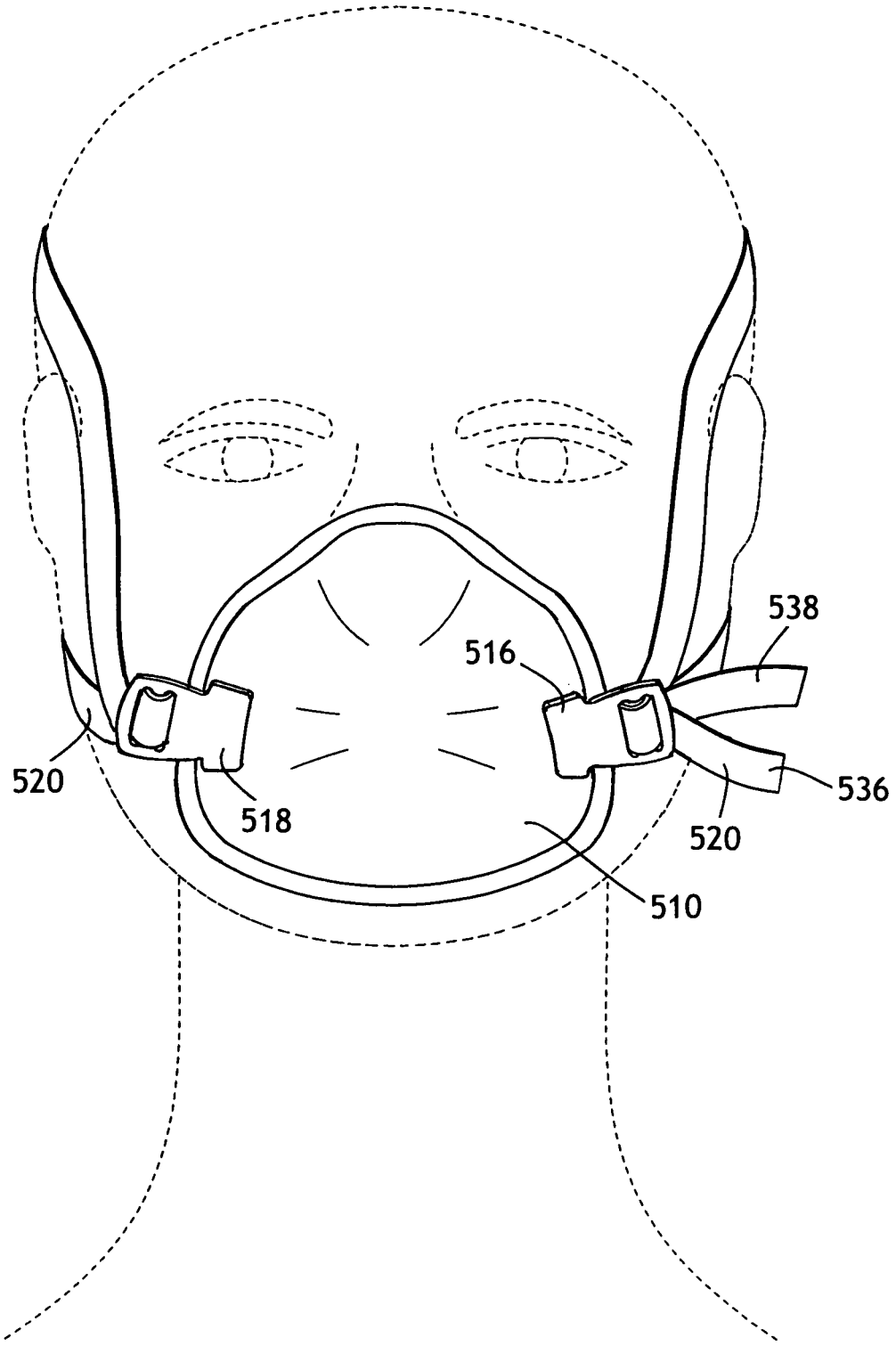
FIG. 5 is a front view of a first embodiment of a respirator worn by a user according to the present disclosure.
Figure 6:
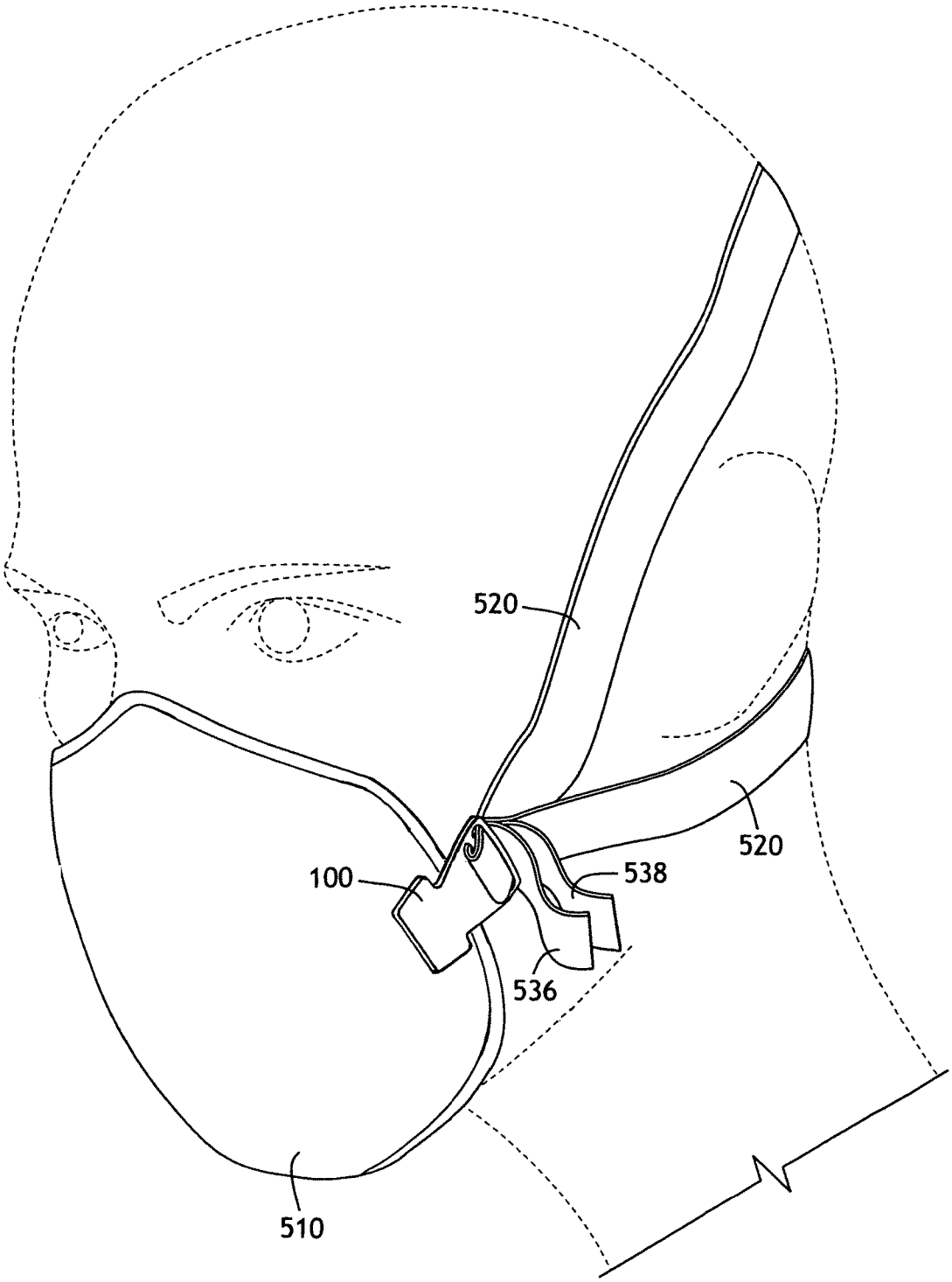
FIG. 6 is a left side perspective view of the respirator shown in FIG. 5.
Figure 7:
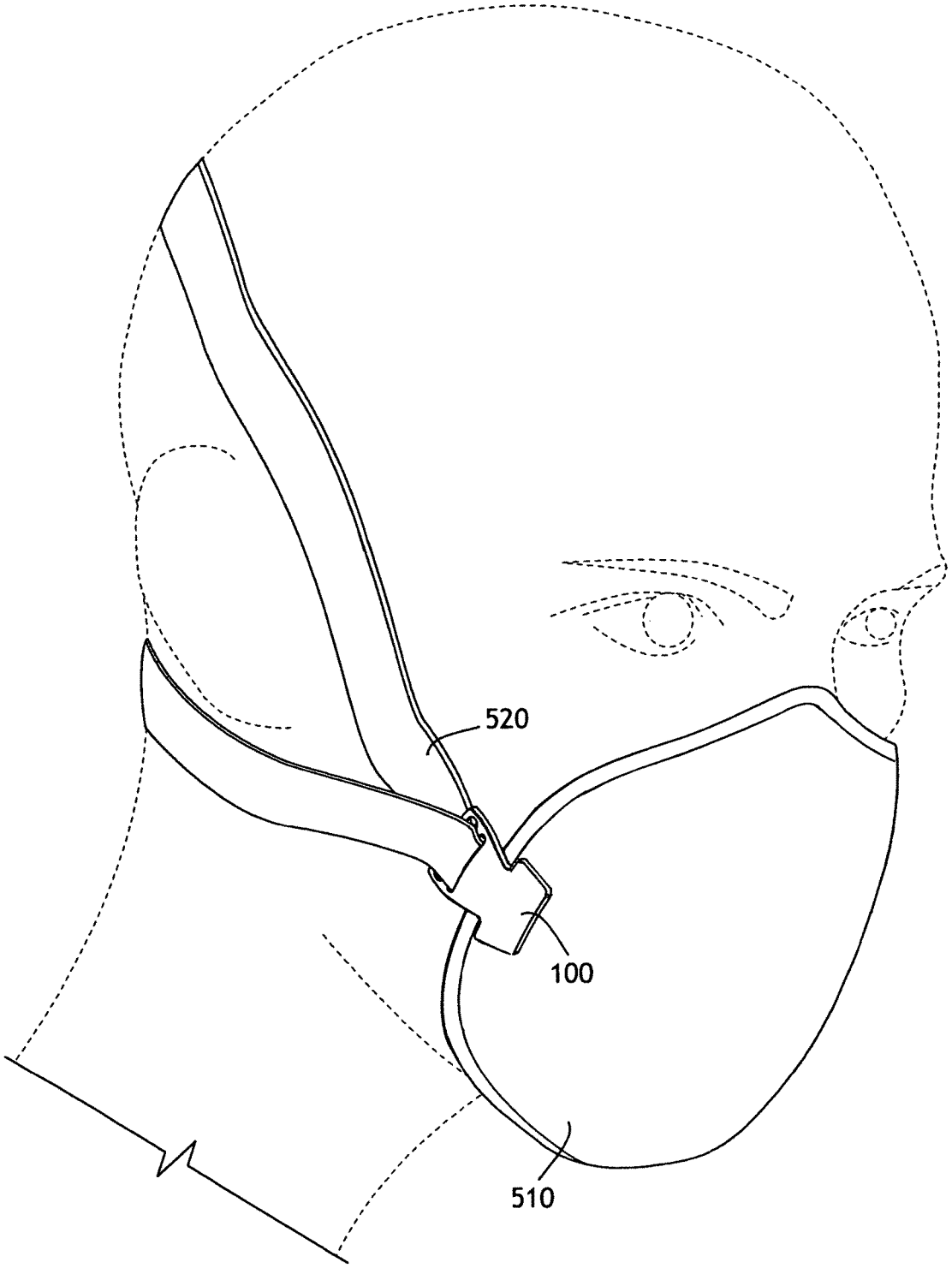
FIG. 7 is a right side view of the respirator shown in FIG. 5.

The main body, e.g., FIG. 5-7, is the portion of the respirator adapted to filter, screen, or otherwise affect at least a portion of one or more constituents in air or gas being inhaled or exhaled through the respirator. Typically, the main body can be in a variety of shapes and sizes, depending upon the desired end use of the respirator. Furthermore, the main body of the respirator, or portions thereof, may be shaped or cut (including the cutting of openings in said main body that are adapted to receive at least a portion of, for example, a fastening component) depending upon the desired end use of the respirator.

In some embodiments, the main body of the respirator is adapted to assume a planar configuration during shipment or storage, but may be opened-up, unfolded, or otherwise deployed at the time of use such that the main body is adapted to fit over some portion of the face of a user. In an alternative embodiment, the main body of the respirator is adapted to assume a pre-formed or pre-molded cupped configuration and is immediately ready for use; that is, no alteration (i.e., unfolding or opening) of the main body is needed to fit over some portion of the face of a user.

Generally, the main body can comprise any suitable material known in the art. For example, the main body of the respirator of the present disclosure can comprise any non-woven web materials, woven materials, knit materials, films, or combinations thereof. In a particularly preferred embodiment, the main body comprises a non-woven web material. Suitable non-woven web materials include meltblown webs, spunbonded webs, bonded carded webs, wet-laid webs, airlaid webs, coform webs, hydraulically entangled webs, and combinations thereof. In addition, non-woven webs may contain synthetic fibers (e.g., polyethylenes, polypropylenes, polyvinyl chlorides, polyvinylidene chlorides, polystyrenes, polyesters, polyamides, polyimides, etc.).

In some embodiments, the main body of the respirator comprises two pull-strap fastening components 100, with each pull-strap fastening component attached to sides of the main body of the respirator. The pull-strap fastening components are located proximate to opposing sides of the user's face when the respirator is worn. Whether there is one or more pull-strap fastening component, to optionally enhance convenient donning or use of the respirator, it can be advantageous to locate the fastening component in the main body of the respirator such that a back edge of the fastening component is located, in order of increasing advantage, within 3.75 cm, within 2.5 cm, within 1.25 cm, and within a range of 0.625 cm to 2.5 cm, of a back edge of the main body of the respirator.

Different pull-strap fastening components may be used. The pull-strap fastening component may be attached to the main body of the respirator in any number of ways know to those in the art. For example, the pull-strap fastening component may be attached to the main body using adhesive; welding; by inputting thermal or other energy to fuse the materials; by using mechanical fastening elements to attach the main body to the pull-strap fastening component (e.g., screws, rivets, snaps, hook-and-loop fasteners, and the like); or other such methods or combinations of methods, so long as the pull-strap fastening component remains attached to the main body during use of the respirator.

Suitable materials for the pull-strap fastening components can include plastics, metals, or combinations thereof. Preferred materials include thermoplastic polymers that can be molded into the desired shape by any of a variety of means known to those in the art, particularly injection molding. Such polymers include polypropylene, polyethylene, acrylonitrile butadiene styrene (ABS), polystyrene, nylon, polyvinyl chloride, and the like.

A strap is connected to the main body of the respirator through a fastening system formed by combining with the pull-strap fastening component attached to the main body (the fastening system is generally depicted in FIG. 1 at 100).

One particularly preferred pull-strap fastening component is shown in FIG. 1 and generally indicated at 100. While the pull-strap fastening component shown in FIG. 1 has an angled or curved shaped, it should be recognized that the pull-strap fastening component can be any shape known in the art that is compatible with that described above. For example, the pull-strap fastening component of an alternative embodiment could be rectangular, thereby, having 90 degree, squared-off corners.

Typically, the pull-strap fastening component comprises at least one slot. In use, the strap is inserted and pulled through the slot. The strap can then be secured to the pull-strap fastening component and the main body of the respirator using the means taught herein.

In one particularly preferred embodiment, as shown in FIG. 1, the pull-strap fastening component comprises two slots, the first slot 20 being located parallel with the second slot 22 and the second slot being located laterally closer in proximity to the user's ear than the first slot. Such a configuration will allow the pull-strap fastening component to act as an adjustment means for the strap, thereby adjusting the fit of the respirator to be either tighter or looser around the user's head. Specifically, in this embodiment, the strap (not shown in FIG. 1, but depicted in FIGS. 5, 6, and 7) is pulled through the first slot 20 of the pull-strap fastening component 100 and then threaded through the second slot 22 of the pull-strap fastening component 100. By pulling more of the strap through the pull-strap fastening component, more tension is created on the strap, thereby producing a tighter fit of the respirator to the user's head.

In one preferred embodiment, each pull-strap fastening component has one slot 20 and one slot 22. In another embodiment, FIG. 9, each pull-strap fastening component has two slots 20 and two slots 22. In such a configuration, both the first and second set of slots can be formed integrally with the pull-strap fastening component and are angled off of the pull-strap fastening component, such as at an angle of about 45 degrees from the end of the pull-strap fastening component at a location proximate to the user's ear.

Advantageously, and as shown in FIGS. 5-7, only one end of the strap needs to be pulled through a pull-strap fastening component by the particular configuration described herein to allow for adjustment. In this way, the respirator 510 is configured to allow the user to adjust the fit of the respirator 510 using a single hand, i.e., the entire strap 520 is adjusted as desired by the user pulling both ends 536, 538 of the strap 520, both of which are located in the pull-strap fastening component 100. As such, the fastening system of the respirator is configured to provide for easier donning and a more comfortable fit.

Figure 8:
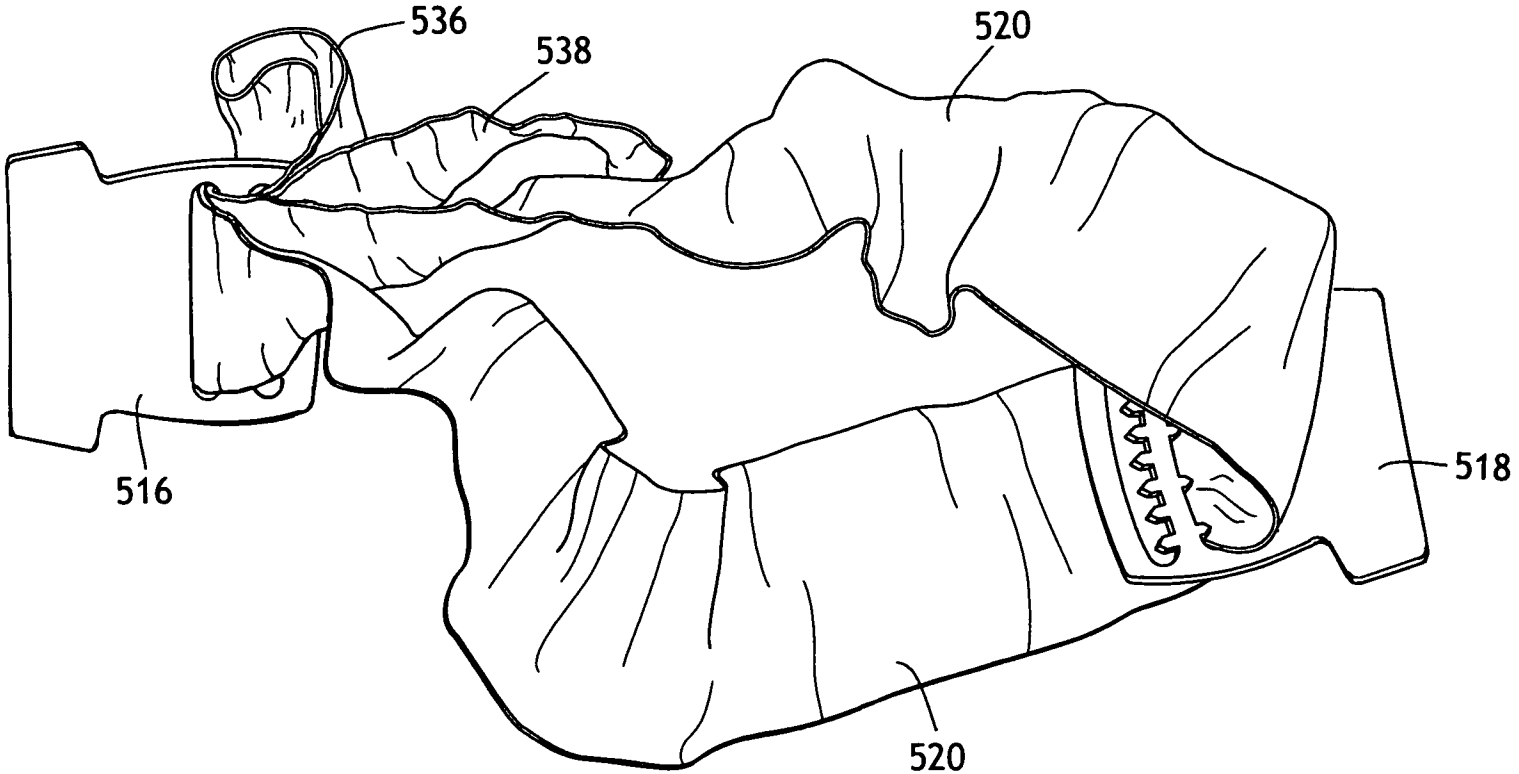
FIG. 8 is a top diagrammatic view of the fastening system and strap used for the respirator shown in FIG. 5, but with an alternate threading scheme.

Referring to FIGS. 5 and 8, the particular configuration of the strap 520 and the pull-strap fastening components 100 are better understood; that is, the strap 520 is a continuous loop of material that has been looped through a first slot on a non-adjustment side pull-strap fastening component 518, such that the strap's middle portion (lengthwise) slidingly engages the internal sides of the first slot of the fastening component 518. Then, the strap 520 extends back around the user's head to the adjustment side pull-strap fastening component 516, where both ends of the strap 520 are threaded through a first slot of the adjustment side pull-strap fastening component 516 and back through a second slot, leaving an adjustment tab portion of the strap 520 extending from the second slot on one side of the respirator 510. When the user dons (i.e., puts on) the respirator, he can adjust the fit by pulling on the adjustment tab portion of the strap, and the tension on the strap equilibrates by free movement of the strap's middle portion through the first slot of the non-adjustment side pull-strap fastening component of the respirator.

Figure 9:
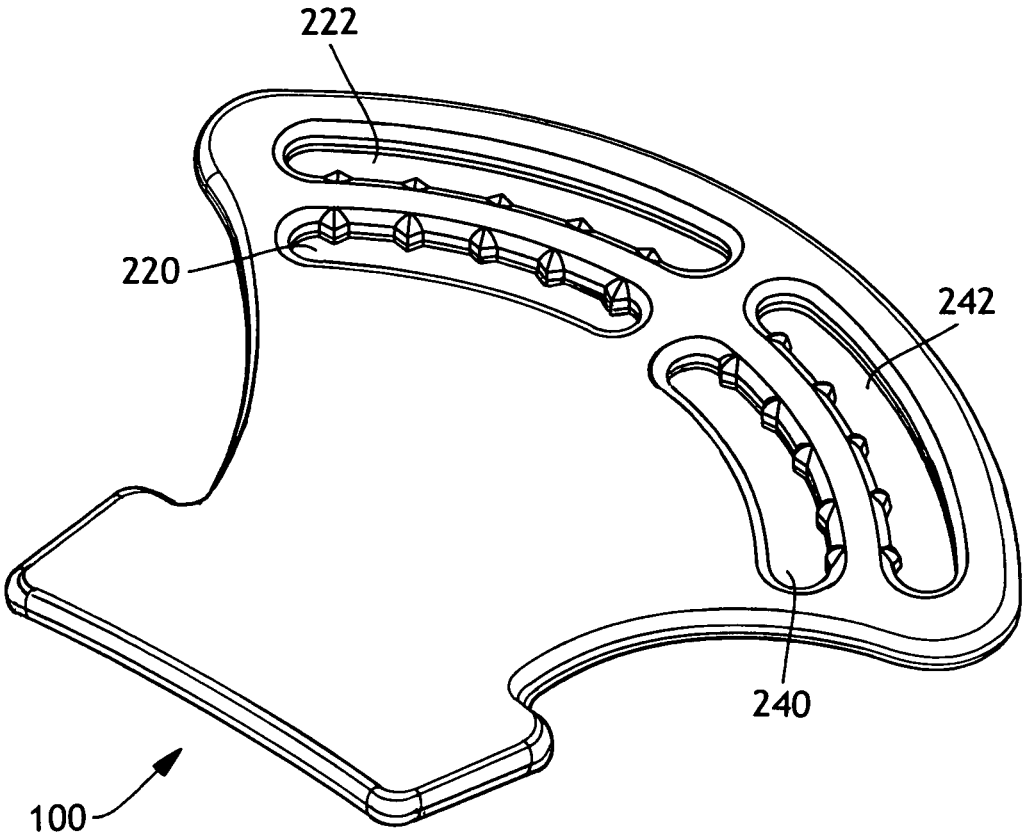
FIG. 9 is a top perspective view of another representative embodiment of a fastening system of the present disclosure.

In another embodiment, as depicted in FIG. 9, the pull-strap fastening component can have more than two slots. For example, in one embodiment as shown the pull-strap fastening component can have four slots, wherein the first slot 220 and second slot 222 are configured as described above and the third slot 240 and fourth slot 242 are configured similarly to the first slot 220 and second slot 222 to each other. Furthermore, the first slot 220 is located longitudinally on the pull-strap fastening component from the third slot 240 and the second slot 222 is located longitudinally on the pull-strap fastening component from the fourth slot 242.

Referring back to FIG. 1, one or more of the slots in the pull-strap fastening component can comprise teeth for gripping the strap. As shown in FIG. 1, the teeth, generally indicated at 40, are disposed on one interior side of the second slot 22. It should be noted that the slots of the pull-strap fastening component can all include teeth or no teeth can be included, without departing from the scope of this disclosure. For example, in FIG. 9 (and other Figures with only 2 slots), the teeth are disposed on one interior side of each of the first slot 220, the second slot 222, the third slot 240, and the fourth slot 242.

Typically, the teeth are shaped to have pointed ends, but it should be understood by one skilled in the art that the teeth can be in any shape or configuration as known in the art. For example, in an alternative embodiment, the teeth are smooth teeth (e.g., have squared-off ends) to keep the strap material from bunching up within the slots. More specifically, the teeth provide resistance in the lateral direction while the strap is pulled through the slot, thereby preventing the strap from bunching up. The teeth can be formed integrally with the pull-strap fastening component or can be made separately and attached, such as with an adhesive or welding, to the interior side of the slot in the pull-strap fastening component.

Furthermore, it has been found that the length and gap of the slots can be optimized for the strap material being used to provide easy adjustment, while also providing a secure hold when in use. Specifically, for the preferred strap material of the present disclosure, the gap formed in the slot of the pull-strap fastening component has a width of suitably from about 1.0 mm to about 1.5 mm. Even more suitably, the gap is about 1.3 mm in width. In the embodiment in which the slot has teeth for gripping or limiting lateral movement or bunching of the strap, the gap is measured from the end of the teeth (opposite from the interior side to which the teeth are attached) to the opposing interior side of the slot. Furthermore, a suitable length of the slot opening (e.g., gap) is between about 75% and 125% of the width of the strap.

The fastening system, formed from the pull-strap fastening component, can be in a variety of sizes or shapes depending upon the desired end use. In one embodiment of the present disclosure, the fastening system has a sufficiently rigid shape, such as a disk, square, or other geometry. In one particularly preferred embodiment, as shown in FIG. 1, the pull-strap fastening component has an overall length of about 31 millimeters, an overall width of about 30 millimeters, and a thickness of about 1 millimeter.

Additionally, to provide for more comfortable donning and wear of the respirator, the straps of the respirator are made of innovative materials and geometries. For instance, the straps are suitably made of flexible elastic materials adapted to encircle the head of the user (e.g., nonwoven materials adapted to stretch). The flexible material is typically a "low power" elastic material; that is, a material that can be stretched at least about 50% and, more preferably, at least about 150% of its relaxed, unstretched length, while having a load of less than 100 grams force per centimeter of width at 100% elongation after having been extended to 133% elongation and retracted to 100% elongation.

More specifically, the flexible material for use as the strap is configured to have a retraction force suitable to provide a sufficiently tight seal to hold the mask (i.e., main body of the respirator) to the user's head, while still allowing a comfortable fit during wear. In one embodiment, the retraction force necessary for the material to be used as a strap material in the respirator of the present disclosure is determined using a Materials Testing System (MTS) Sintech 1/S tensile testing frame and the following described method. Specifically, a 15.24 cm (6 inch) long sample of the strap material is inserted between two testing jaws (2.54 cm tall by 7.62 cm wide; 1 inch tall by 3 inches wide), where the direction of the stretch of the headband strap material is the 15.24 cm (6 inches) dimension of the sample. For strap materials less than 2.54 cm (1 inch) in width, the material is cut to width. For samples greater than 2.54 cm (1 inch), the material is cut to 2.54 cm (1 inch) in width. The initial gauge distance between the jaws was set at 7.62 cm (3 inch) and the sample materials were extended and retracted at a rate of 50.8 cm per minute (20 inch per minute) via the cross-head movement. The resulting load and extension were recorded and charted. The units for load were normalized to grams force per centimeter of width of the material.

Figure 10:
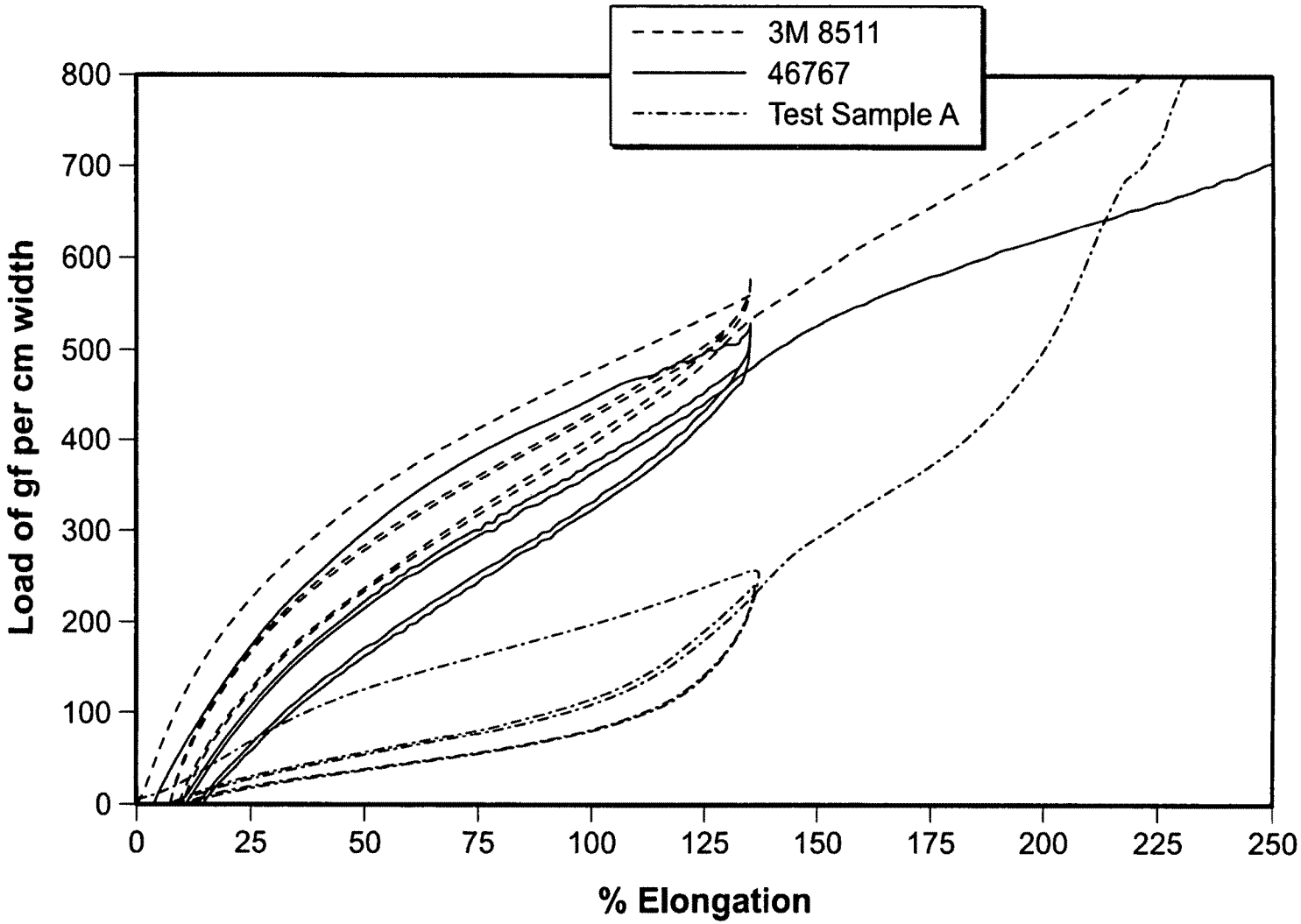
FIG. 10 is a graph depicting the retraction force of the strap materials used for the respirator of the present disclosure as compared to commercially available strap materials.

Suitably, the materials for use as the strap material are configured to have a retraction force in the range of from about 30 grams force to about 100 grams force per centimeter in width at 100% elongation after having been extended to 133% elongation and retracted to 100% elongation. More suitably, the materials have a retraction force of from about 50 grams force to about 70 grams force per centimeter in width at 100% elongation after having been extended to 133% elongation and retracted to 100% elongation. Furthermore, as seen in FIG. 10, as compared to the commercially available strap materials, 3M 8511 (available from 3M Worldwide, St. Paul, Minn.) and respirator code No. 46767 (available from Kimberly-Clark Worldwide, Inc., Neenah, Wis.), the strap materials used in the present disclosure (Sample A) provide less retractive force per width. In order to affect sufficient force to seal the body of the respirator to the face a wider headband is used. The wider headband distributes the force of the headband across a wider area across the back of the users head resulting in less pressure and greater comfort.

The hysteresis effect of the sample strap material was also analyzed to determine the strap materials' ability to repeatedly be easily and comfortably donned. Elastic materials tend to stretch, deform, and re-align at the molecular level as they are strained. Specifically, a cyclical displacement of the strap material will result in a hysteresis loop of the load or stress. The load at a given elongation during retraction is generally lower than the load at the same elongation during extension. In addition, the load during the initial extension is generally higher than during subsequent extensions due to permanent deformations caused during the initial cycle. The hysteresis effect can be characterized by the ratio of the load under retraction at a given elongation to the load at extension at the same elongation. Specifically, in one embodiment, the strap materials were cycled twice to 133% elongation and back to the original length at a rate of 50.8 centimeters per minute (20 inches per minute).

The amount of permanent deformation after elongation in the strap material can also be analyzed by its tension set. Specifically, tension set is the percent elongation at which the tension falls to zero upon retraction after a given amount of elongation. Lower tension set is more desirable, ideally less than 25% set after extension to 133%.

Additionally, the strength of the strap materials was also analyzed. To assess the strength of the materials, the sample materials were extended at a rate of 50.8 cm per minute (20 inches per minute) in the tensile frame until they failed or the load dropped by 10% from its peak. The strap must be strong enough to withstand the extension during donning. This strength is a function of the strength per width of the strap material and the width of the material used as the strap and is typically at least 300 grams force.

Particularly suitable examples of materials for use as the strap materials in the respirators of the present disclosure include laminates made by thermally or adhesively bonding nonwoven materials to elastomeric films. Suitable laminates include, for example, elastic films, stretch-bonded laminates, vertical filament laminates, necked bonded laminates, woven materials and nonwoven materials of elastic fibers, composites of elastic fibers and nonwoven materials, laminates of elastic films and extensible facings, and combinations thereof. A preferred strap material is made of a thermal laminate of two nonwoven facings thermally bonded to each side of elastomeric films such that apertures are created in the film material without being created in the facings. This allows the film material to become breathable and, thus, more comfortable to wear by the user.

Any of a variety of thermoplastic elastomeric polymers may generally be employed in strap materials of the present disclosure, such as elastomeric polyesters, elastomeric polyurethanes, elastomeric polyamides, elastomeric copolymers, elastomeric polyolefins, and the like. In one particular embodiment, elastomeric semi-crystalline polyolefins are employed due to their unique combinations of mechanical and elastomeric properties. That is, the mechanical properties of such semi-crystalline polyolefins allows for the formation of films that readily aperture during thermal bonding, as discussed above, yet retain their elasticity.

Semi-crystalline polyolefins have or are capable of exhibiting a substantially regular structure. For example, semi-crystalline polyolefins may be substantially amorphous in their undeformed state, but form crystalline domains upon stretching. The degree of crystallinity of the olefin polymer may be from about 3% to about 30%, in some embodiments from about 5% to about 25%, and in some embodiments, from about 5% and about 15%. Likewise, the semi-crystalline polyolefin may have a latent heat of fusion ($\Delta H_f$), which is another indicator of the degree of crystallinity, of from about 15 to about 75 Joules per gram ("J/g"), in some embodiments from about 20 to about 65 J/g, and in some embodiments, from 25 to about 50 J/g. The semi-crystalline polyolefin may also have a Vicat softening temperature of from about 10° C. to about 100° C., in some embodiments from about 20° C. to about 80° C., and in some embodiments, from about 30° C. to about 60° C. The semi-crystalline polyolefin may have a melting temperature of from about 20° C. to about 120° C., in some embodiments from about 35° C. to about 90° C., and in some embodiments, from about 40° C. to about 80° C. The latent heat of fusion ($\Delta H_f$) and melting temperature may be determined using differential scanning calorimetry ("DSC") in accordance with ASTM D-3417 as is well known to those skilled in the art. The Vicat softening temperature may be determined in accordance with ASTM D-1525.

Exemplary semi-crystalline polyolefins include polyethylene, polypropylene, blends and copolymers thereof. In one particular embodiment, a polyethylene is employed that is a copolymer of ethylene and an α-olefin, such as a $C_3$-$C_{20}$ α-olefin or $C_3$-$C_{12}$ α-olefin. Suitable α-olefins may be linear or branched (e.g., one or more $C_1$-$C_3$ alkyl branches, or an aryl group). Specific examples include 1-butene; 3-methyl-1-butene; 3,3-dimethyl-1-butene; 1-pentene; 1-pentene with one or more methyl, ethyl or propyl substituents; 1-hexene with one or more methyl, ethyl or propyl substituents; 1-heptene with one or more methyl, ethyl or propyl substituents; 1-octene with one or more methyl, ethyl or propyl substituents; 1-nonene with one or more methyl, ethyl or propyl substituents; ethyl, methyl or dimethyl-substituted 1-decene; 1-dodecene; and styrene. Particularly desired α-olefin comonomers are 1-butene, 1-hexene and 1-octene. The ethylene content of such copolymers may be from about 60 mole % to about 99 mole %, in some embodiments from about 80 mole % to about 98.5 mole %, and in some embodiments, from about 87 mole % to about 97.5 mole %. The α-olefin content may likewise range from about 1 mole % to about 40 mole %, in some embodiments from about 1.5 mole % to about 15 mole %, and in some embodiments, from about 2.5 mole % to about 13 mole %.

The density of the polyethylene may vary depending on the type of polymer employed, but generally ranges from 0.85 to 0.96 grams per cubic centimeter ("g/cm$^3$"). Polyethylene "plastomers", for instance, may have a density in the range of from 0.85 to 0.91 g/cm$^3$. Likewise, "linear low density polyethylene" ("LLDPE") may have a density in the range of from 0.91 to 0.940 g/cm$^3$; "low density polyethylene" ("LDPE") may have a density in the range of from 0.910 to 0.940 g/cm$^3$; and "high density polyethylene" ("HDPE") may have density in the range of from 0.940 to 0.960 g/cm$^3$. Densities may be measured in accordance with ASTM 1505.

Particularly suitable polyethylene copolymers are those that are "linear" or "substantially linear." The term "substantially linear" means that, in addition to the short chain branches attributable to comonomer incorporation, the ethylene polymer also contains long chain branches in that the polymer backbone. "Long chain branching" refers to a chain length of at least 6 carbons. Each long chain branch may have the same comonomer distribution as the polymer backbone and be as long as the polymer backbone to which it is attached. Preferred substantially linear polymers are substituted with from 0.01 long chain branch per 1000 carbons to 1 long chain branch per 1000 carbons, and in some embodiments, from 0.05 long chain branch per 1000 carbons to 1 long chain branch per 1000 carbons. In contrast to the term "substantially linear", the term "linear" means that the polymer lacks measurable or demonstrable long chain branches. That is, the polymer is substituted with an average of less than 0.01 long chain branch per 1000 carbons.

The density of a linear ethylene/α-olefin copolymer is a function of both the length and amount of the α-olefin. That is, the greater the length of the α-olefin and the greater the amount of α-olefin present, the lower the density of the copolymer. Although not necessarily required, linear polyethylene "plastomers" are particularly desirable in that the content of α-olefin short chain branching content is such that the ethylene copolymer exhibits both plastic and elastomeric characteristics (i.e., a "plastomer"). Because polymerization with α-olefin comonomers decreases crystallinity and density, the resulting plastomer normally has a density lower than that of polyethylene thermoplastic polymers (e.g., LLDPE), but approaching and/or overlapping that of an elastomer. For example, the density of the polyethylene plastomer may be 0.91 grams per cubic centimeter ($g/cm^3$) or less, in some embodiments, from 0.85 to 0.88 $g/cm^3$, and in some embodiments, from 0.85 $g/cm^3$ to 0.87 $g/cm^3$. Despite having a density similar to elastomers, plastomers generally exhibit a higher degree of crystallinity, are relatively non-tacky, and may be formed into pellets that are non-adhesive and relatively free flowing.

The distribution of the α-olefin comonomer within a polyethylene plastomer is typically random and uniform among the differing molecular weight fractions forming the ethylene copolymer. This uniformity of comonomer distribution within the plastomer may be expressed as a comonomer distribution breadth index value ("CDBI") of 60 or more, in some embodiments 80 or more, and in some embodiments, 90 or more. Further, the polyethylene plastomer may be characterized by a DSC melting point curve that exhibits the occurrence of a single melting point peak occurring in the region of 50 to 110° C. (second melt rundown).

Preferred plastomers for use in the present disclosure are ethylene-based copolymer plastomers available under the designation EXACT™ from ExxonMobil Chemical Company of Houston, Tex. Other suitable polyethylene plastomers are available under the designation ENGAGE™ and AFFINITY™ from Dow Chemical Company of Midland, Mich. Still other suitable ethylene polymers are available from The Dow Chemical Company under the designations DOWLEX™ (LLDPE) and ATTANE™ (ULDPE). Other suitable ethylene polymers are described in U.S. Pat. No. 4,937,299 to Ewen et al.; U.S. Pat. No. 5,218,071 to Tsutsui et al.; U.S. Pat. No. 5,272,236 to Lai, et al.; and U.S. Pat. No. 5,278,272 to Lai, et al., which are incorporated herein in their entirety by reference to the extent they are consistent herewith.

Of course, the present disclosure is by no means limited to the use of ethylene polymers. For instance, propylene polymers may also be suitable for use as a semi-crystalline polyolefin. Suitable plastomeric propylene polymers may include, for instance, copolymers or terpolymers of propylene include copolymers of propylene with an α-olefin (e.g., $C_3$-$C_{20}$), such as ethylene, 1-butene, 2-butene, the various pentene isomers, 1-hexene, 1-octene, 1-nonene, 1-decene, 1-unidecene, 1-dodecene, 4-methyl-1-pentene, 4-methyl-1-hexene, 5-methyl-1-hexene, vinylcyclohexene, styrene, etc. The comonomer content of the propylene polymer may be about 35 wt. % or less, in some embodiments from about 1 wt. % to about 20 wt. %, and in some embodiments, from about 2 wt. % to about 10 wt. %. Preferably, the density of the polypropylene (e.g., propylene/α-olefin copolymer) may be 0.91 grams per cubic centimeter ($g/cm^3$) or less, in some embodiments, from 0.85 to 0.88 $g/cm^3$, and in some embodiments, from 0.85 $g/cm^3$ to 0.87 $g/cm^3$. Suitable propylene polymers are commercially available under the designations VISTAMAXX™ from ExxonMobil Chemical Co. of Houston, Tex.; FINA™ (e.g., 8573) from Atofina Chemicals of Feluy, Belgium; TAFMER™ available from Mitsui Petrochemical Industries; and VERSIFY™ available from Dow Chemical Co. of Midland, Mich. Other examples of suitable propylene polymers are described in U.S. Pat. No. 6,500,563 to Datta, et al.; U.S. Pat. No. 5,539,056 to Yang, et al.; and U.S. Pat. No. 5,596,052 to Resconi, et al., which are incorporated herein in their entirety by reference to the extent they are consistent herewith.

Any of a variety of known techniques may generally be employed to form the semi-crystalline polyolefins. For instance, olefin polymers may be formed using a free radical or a coordination catalyst (e.g., Ziegler-Natta). Preferably, the olefin polymer is formed from a single-site coordination catalyst, such as a metallocene catalyst. Such a catalyst system produces ethylene copolymers in which the comonomer is randomly distributed within a molecular chain and uniformly distributed across the different molecular weight fractions. Metallocene-catalyzed polyolefins are described, for instance, in U.S. Pat. No. 5,571,619 to McAlpin et al.; U.S. Pat. No. 5,322,728 to Davis et al.; U.S. Pat. No. 5,472,775 to Obijeski et al.; U.S. Pat. No. 5,272,236 to Lai et al.; and U.S. Pat. No. 6,090,325 to Wheat, et al., which are incorporated herein in their entirety by reference to the extent they are consistent herewith. Examples of metallocene catalysts include bis(n-butylcyclopentadienyl)titanium dichloride, bis(n-butylcyclopentadienyl)zirconium dichloride, bis(cyclopentadienyl)scandium chloride, bis(indenyl) zirconium dichloride, bis(methylcyclopentadienyl)titanium dichloride, bis(methylcyclopentadienyl)zirconium dichloride, cobaltocene, cyclopentadienyltitanium trichloride, ferrocene, hafnocene dichloride, isopropyl(cyclopentadienyl, -1-flourenyl)zirconium dichloride, molybdocene dichloride, nickelocene, niobocene dichloride, ruthenocene, titanocene dichloride, zirconocene chloride hydride, zirconocene dichloride, and so forth. Polymers made using metallocene catalysts typically have a narrow molecular weight range. For instance, metallocene-catalyzed polymers may have polydispersity numbers ($M_w/M_n$) of below 4, controlled short chain branching distribution, and controlled isotacticity.

The melt flow index (MI) of the semi-crystalline polyolefins may generally vary, but is typically in the range of about 0.1 grams per 10 minutes to about 100 grams per 10 minutes, in some embodiments from about 0.5 grams per 10 minutes to about 30 grams per 10 minutes, and in some embodiments, about 1 to about 10 grams per 10 minutes, determined at 190° C. The melt flow index is the weight of the polymer (in grams) that may be forced through an extrusion rheometer orifice (0.0825-inch diameter) when subjected to a force of 5000 grams in 10 minutes at 190EC, and may be determined in accordance with ASTM Test Method D1238-E.

Of course, other thermoplastic polymers may also be used to form the elastic film, either alone or in conjunction with the semi-crystalline polyolefins. For instance, a substantially amorphous block copolymer may be employed that has at least two blocks of a monoalkenyl arene polymer separated by at least one block of a saturated conjugated diene polymer. The monoalkenyl arene blocks may include styrene and its analogues and homologues, such as o-methyl styrene; p-methyl styrene; p-tert-butyl styrene; 1,3 dimethyl styrene p-methyl styrene; etc., as well as other monoalkenyl polycyclic aromatic compounds, such as vinyl naphthalene; vinyl anthrycene; and so forth. Preferred monoalkenyl arenes are styrene and p-methyl styrene. The conjugated diene blocks may include homopolymers of conjugated diene monomers, copolymers of two or more conjugated dienes, and copolymers of one or more of the dienes with another monomer in which the blocks are predominantly conjugated diene units. Preferably, the conjugated dienes contain from 4 to 8 carbon atoms, such as 1,3 butadiene (butadiene); 2-methyl-1,3 butadiene; isoprene; 2,3 dimethyl-1,3 butadiene; 1,3 pentadiene (piperylene); 1,3 hexadiene; and so forth.

The amount of monoalkenyl arene (e.g., polystyrene) blocks may vary, but typically constitute from about 8 wt. % to about 55 wt. %, in some embodiments from about 10 wt.

% to about 35 wt. %, and in some embodiments, from about 25 wt. % to about 35 wt. % of the copolymer. Suitable block copolymers may contain monoalkenyl arene endblocks having a number average molecular weight from about 5,000 to about 35,000 and saturated conjugated diene midblocks having a number average molecular weight from about 20,000 to about 170,000. The total number average molecular weight of the block polymer may be from about 30,000 to about 250,000.

Particularly suitable thermoplastic elastomeric copolymers are available from Kraton Polymers LLC of Houston, Tex. under the trade name KRATON®. KRATON® polymers include styrene-diene block copolymers, such as styrene-butadiene, styrene-isoprene, styrene-butadiene-styrene, and styrene-isoprene-styrene. KRATON® polymers also include styrene-olefin block copolymers formed by selective hydrogenation of styrene-diene block copolymers. Examples of such styrene-olefin block copolymers include styrene-(ethylene-butylene), styrene-(ethylene-propylene), styrene-(ethylene-butylene)-styrene, styrene-(ethylene-propylene)-styrene, styrene-(ethylene-butylene)-styrene-(ethylene-butylene), styrene-(ethylene-propylene)-styrene-(ethylene-propylene), and styrene-ethylene-(ethylene-propylene)-styrene. These block copolymers may have a linear, radial or star-shaped molecular configuration. Specific KRATON® block copolymers include those sold under the brand names G 1652, G 1657, G 1730, MD6673, and MD6973. Various suitable styrenic block copolymers are described in U.S. Pat. Nos. 4,663,220, 4,323,534, 4,834,738, 5,093,422 and 5,304,599, which are hereby incorporated in their entirety by reference to the extent they are consistent herewith. Other commercially available block copolymers include the S-EP-S elastomeric copolymers available from Kuraray Company, Ltd. of Okayama, Japan, under the trade designation SEPTON®. Still other suitable copolymers include the S-I-S and S-B-S elastomeric copolymers available from Dexco Polymers of Houston, Tex. under the trade designation VECTOR®. Also suitable are polymers composed of an A-B-A-B tetrablock copolymer, such as discussed in U.S. Pat. No. 5,332,613 to Taylor, et al., which is incorporated herein in its entirety by reference to the extent it is consistent herewith. An example of such a tetrablock copolymer is a styrene-poly(ethylene-propylene)-styrene-poly(ethylene-propylene) ("S-EP-S-EP") block copolymer.

The amount of elastomeric polymer(s) employed in the film may vary, but is typically about 30 wt. % or more of the film, in some embodiments about 50 wt. % or more, and in some embodiments, about 80 wt. % or more of the of the film. In one embodiment, for example, the semi-crystalline polyolefin(s) constitute about 70 wt. % or more of the film, in some embodiments about 80 wt. % or more of the film, and in some embodiments, about 90 wt. % or more of the film. In other embodiments, blends of semi-crystalline polyolefin(s) and elastomeric block copolymer(s) may be employed. In such embodiments, the block copolymer(s) may constitute from about 5 wt. % to about 50 wt. %, in some embodiments from about 10 wt. % to about 40 wt. %, and in some embodiments, from about 15 wt. % to about 35 wt. % of the blend. Likewise, the semi-crystalline polyolefin(s) may constitute from about 50 wt. % to about 95 wt. %, in some embodiments from about 60 wt. % to about 90 wt. %, and in some embodiments, from about 65 wt. % to about 85 wt. % of the blend. It should of course be understood that other elastomeric and/or non-elastomeric polymers may also be employed in the film.

Besides polymers, the elastic film of the present disclosure may also contain other components as is known in the art. In one embodiment, for example, the elastic film contains a filler. Fillers are particulates or other forms of material that may be added to the film polymer extrusion blend and that will not chemically interfere with the extruded film, but which may be uniformly dispersed throughout the film. Fillers may serve a variety of purposes, including enhancing film opacity and/or breathability (i.e., vapor-permeable and substantially liquid-impermeable). For instance, filled films may be made breathable by stretching, which causes the polymer to break away from the filler and create microporous passageways. Breathable microporous elastic films are described, for example, in U.S. Pat. Nos. 5,997,981; 6,015,764; and 6,111,163 to McCormack, et al.; U.S. Pat. No. 5,932,497 to Morman, et al.; U.S. Pat. No. 6,461,457 to Taylor, et al., which are incorporated herein in their entirety by reference to the extent they are consistent herewith.

The fillers may have a spherical or non-spherical shape with average particle sizes in the range of from about 0.1 to about 7 microns. Examples of suitable fillers include, but are not limited to, calcium carbonate, various kinds of clay, silica, alumina, barium carbonate, sodium carbonate, magnesium carbonate, talc, barium sulfate, magnesium sulfate, aluminum sulfate, titanium dioxide, zeolites, cellulose-type powders, kaolin, mica, carbon, calcium oxide, magnesium oxide, aluminum hydroxide, pulp powder, wood powder, cellulose derivatives, chitin and chitin derivatives. A suitable coating, such as stearic acid, may also be applied to the filler particles if desired. When utilized, the filler content may vary, such as from about 25 wt. % to about 75 wt. %, in some embodiments, from about 30 wt. % to about 70 wt. %, and in some embodiments, from about 40 wt. % to about 60 wt. % of the film.

Other additives may also be incorporated into the film, such as melt stabilizers, processing stabilizers, heat stabilizers, light stabilizers, antioxidants, heat aging stabilizers, whitening agents, antiblocking agents, bonding agents, tackifiers, viscosity modifiers, etc. Examples of suitable tackifier resins may include, for instance, hydrogenated hydrocarbon resins. REGALREZ™ hydrocarbon resins are examples of such hydrogenated hydrocarbon resins, and are available from Eastman Chemical. Other tackifiers are available from ExxonMobil under the ESCOREZ™ designation. Viscosity modifiers may also be employed, such as polyethylene wax (e.g., EPOLENE™ C-10 from Eastman Chemical). Phosphite stabilizers (e.g., IRGAFOS available from Ciba Specialty Chemicals of Terrytown, N.Y. and DOVERPHOS available from Dover Chemical Corp. of Dover, Ohio) are exemplary melt stabilizers. In addition, hindered amine stabilizers (e.g., CHIMASSORB available from Ciba Specialty Chemicals) are exemplary heat and light stabilizers. Further, hindered phenols are commonly used as an antioxidant in the production of films. Some suitable hindered phenols include those available from Ciba Specialty Chemicals of under the trade name "Irganox®", such as Irganox® 1076, 1010, or E 201. Moreover, bonding agents may also be added to the film to facilitate bonding of the film to additional materials (e.g., nonwoven web). When employed, such additives (e.g., tackifier, antioxidant, stabilizer, etc.) may each be present in an amount from about 0.001 wt. % to about 25 wt. %, in some embodiments, from about 0.005 wt. % to about 20 wt. %, and in some embodiments, from 0.01 wt. % to about 15 wt. % of the film.

The elastic films of the present disclosure may be mono- or multi-layered. Multilayer films may be prepared by co-extrusion of the layers, extrusion coating, or by any conventional layering process. Such multilayer films normally contain at least one base layer and at least one skin layer, but may contain any number of layers desired. For example, the multilayer film may be formed from a base layer and one or more skin layers, wherein the base layer is formed from a semi-crystalline polyolefin. In such embodiments, the skin layer(s) may be formed from any film-forming polymer. If desired, the skin layer(s) may contain a softer, lower melting polymer or polymer blend that renders the layer(s) more suitable as heat seal bonding layers for thermally bonding the film to a nonwoven web. For example, the skin layer(s) may be formed from an olefin polymer or blends thereof, such as described above. Additional film-forming polymers that may be suitable for use with the present disclosure, alone or in combination with other polymers, include ethylene vinyl acetate, ethylene ethyl acrylate, ethylene acrylic acid, ethylene methyl acrylate, ethylene normal butyl acrylate, nylon, ethylene vinyl alcohol, polystyrene, polyurethane, and so forth.

The thickness of the skin layer(s) is generally selected so as not to substantially impair the elastomeric properties of the film. To this end, each skin layer may separately comprise from about 0.5% to about 15% of the total thickness of the film, and in some embodiments from about 1% to about 10% of the total thickness of the film. For instance, each skin layer may have a thickness of from about 0.1 to about 10 micrometers, in some embodiments from about 0.5 to about 5 micrometers, and in some embodiments, from about 1 to about 2.5 micrometers. Likewise, the base layer may have a thickness of from about 1 to about 40 micrometers, in some embodiments from about 2 to about 25 micrometers, and in some embodiments, from about 5 to about 20 micrometers.

The properties of the resulting film may generally vary as desired. For instance, prior to stretching, the film typically has a basis weight of about 100 grams per square meter or less, and in some embodiments, from about 50 to about 75 grams per square meter. Upon stretching, the film typically has a basis weight of about 60 grams per square meter or less, and in some embodiments, from about 15 to about 35 grams per square meter. The stretched film may also have a total thickness of from about 1 to about 100 micrometers, in some embodiments, from about 10 to about 80 micrometers, and in some embodiments, from about 20 to about 60 micrometers.

As will be described in more detail below, the polymers used to form the nonwoven web material typically have a softening temperature that is higher than the temperature imparted during bonding. In this manner, the polymers do not substantially soften during bonding to such an extent that the fibers of the nonwoven web material become completely melt flowable. For instance, polymers may be employed that have a Vicat softening temperature (ASTM D-1525) of from about 100° C. to about 300° C., in some embodiments from about 120° C. to about 250° C., and in some embodiments, from about 130° C. to about 200° C. Exemplary high-softening point polymers for use in forming nonwoven web materials may include, for instance, polyolefins, e.g., polyethylene, polypropylene, polybutylene, etc.; polytetrafluoroethylene; polyesters, e.g., polyethylene terephthalate and so forth; polyvinyl acetate; polyvinyl chloride acetate; polyvinyl butyral; acrylic resins, e.g., polyacrylate, polymethylacrylate, polymethylmethacrylate, and so forth; polyamides, e.g., nylon; polyvinyl chloride; polyvinylidene chloride; polystyrene; polyvinyl alcohol; polyurethanes; polylactic acid; copolymers thereof; and so forth. If desired, biodegradable polymers, such as those described above, may also be employed. Synthetic or natural cellulosic polymers may also be used, including but not limited to, cellulosic esters; cellulosic ethers; cellulosic nitrates; cellulosic acetates; cellulosic acetate butyrates; ethyl cellulose; regenerated celluloses, such as viscose, rayon, and so forth. It should be noted that the polymer(s) may also contain other additives, such as processing aids or treatment compositions to impart desired properties to the fibers, residual amounts of solvents, pigments or colorants, and so forth.

Monocomponent and/or multicomponent fibers may be used to form the nonwoven web material. Monocomponent fibers are generally formed from a polymer or blend of polymers extruded from a single extruder. Multicomponent fibers are generally formed from two or more polymers (e.g., bicomponent fibers) extruded from separate extruders. The polymers may be arranged in substantially constantly positioned distinct zones across the cross-section of the fibers. The components may be arranged in any desired configuration, such as sheath-core, side-by-side, pie, island-in-the-sea, three island, bull's eye, or various other arrangements known in the art, and the like. Various methods for forming multicomponent fibers are described in U.S. Pat. No. 4,789,592 to Taniguchi et al. and U.S. Pat. No. 5,336,552 to Strack et al.; U.S. Pat. No. 5,108,820 to Kaneko, et al.; U.S. Pat. No. 4,795,668 to Kruege, et al.; U.S. Pat. No. 5,382,400 to Pike, et al.; U.S. Pat. No. 5,336,552 to Strack, et al.; and U.S. Pat. No. 6,200,669 to Marmon, et al.; which are incorporated herein in their entirety by reference to the extent they are consistent herewith. Multicomponent fibers having various irregular shapes may also be formed, such as described in U.S. Pat. No. 5,277,976 to Hogle, et al., U.S. Pat. No. 5,162,074 to Hills, U.S. Pat. No. 5,466,410 to Hills, U.S. Pat. No. 5,069,970 to Largman, et al., and U.S. Pat. No. 5,057,368 to Largman, et al., which are incorporated herein in their entirety by reference to the extent they are consistent herewith.

Although any combination of polymers may be used, the polymers of the multicomponent fibers are typically made from thermoplastic materials with different glass transition or melting temperatures where a first component (e.g., sheath) melts at a temperature lower than a second component (e.g., core). Softening or melting of the first polymer component of the multicomponent fiber allows the multicomponent fibers to form a tacky skeletal structure, which upon cooling, stabilizes the fibrous structure. For example, the multicomponent fibers may have from about 20% to about 80%, and in some embodiments, from about 40% to about 60% by weight of the low melting polymer. Further, the multicomponent fibers may have from about 80% to about 20%, and in some embodiments, from about 60% to about 40%, by weight of the high melting polymer. Some examples of known sheath-core bicomponent fibers available from KoSa Inc. of Charlotte, N.C. under the designations T-255 and T-256, both of which use a polyolefin sheath, or T-254, which has a low melt co-polyester sheath. Still other known bicomponent fibers that may be used include those available from the Chisso Corporation of Moriyama, Japan or Fibervisions LLC of Wilmington, Del.

Fibers of any desired length may be employed, such as staple fibers, continuous fibers, etc. In one particular embodiment, for example, staple fibers may be used that have a fiber length in the range of from about 1 to about 150 millimeters, in some embodiments from about 5 to about 50 millimeters, in some embodiments from about 10 to about 40 millimeters, and in some embodiments, from about 10 to about 25 millimeters. Although not required, carding techniques may be employed to form fibrous layers with staple fibers as is well known in the art. For example, fibers may be formed into a carded web by placing bales of the fibers into a picker that separates the fibers. Next, the fibers are sent through a combing or carding unit that further breaks apart and aligns the fibers in the machine direction so as to form a machine direction-oriented fibrous nonwoven web. The carded web may then be bonded using known techniques to form a bonded carded nonwoven web.

If desired, the nonwoven web material used to form the nonwoven composite may have a multi-layer structure. Suitable multi-layered materials may include, for instance, spunbond/meltblown/spunbond (SMS) laminates and spunbond/meltblown (SM) laminates. Various examples of suitable SMS laminates are described in U.S. Pat. No. 4,041,203 to Brock et al.; U.S. Pat. No. 5,213,881 to Timmons, et al.; U.S. Pat. No. 5,464,688 to Timmons, et al.; U.S. Pat. No. 4,374,888 to Bornslaeger; U.S. Pat. No. 5,169,706 to Collier, et al.; and U.S. Pat. No. 4,766,029 to Brock et al., which are incorporated herein in their entirety by reference to the extent they are consistent herewith. In addition, commercially available SMS laminates may be obtained from Kimberly-Clark Corporation under the designations Spunguard® and Evolution®.

Another example of a multi-layered structure is a spunbond web produced on a multiple spin bank machine in which a spin bank deposits fibers over a layer of fibers deposited from a previous spin bank. Such an individual spunbond nonwoven web may also be thought of as a multi-layered structure. In this situation, the various layers of deposited fibers in the nonwoven web may be the same, or they may be different in basis weight and/or in terms of the composition, type, size, level of crimp, and/or shape of the fibers produced. As another example, a single nonwoven web may be provided as two or more individually produced layers of a spunbond web, a carded web, etc., which have been bonded together to form the nonwoven web. These individually produced layers may differ in terms of production method, basis weight, composition, and fibers as discussed above.

A nonwoven web material may also contain an additional fibrous component such that it is considered a composite. For example, a nonwoven web may be entangled with another fibrous component using any of a variety of entanglement techniques known in the art (e.g., hydraulic, air, mechanical, etc.). In one embodiment, the nonwoven web is integrally entangled with cellulosic fibers using hydraulic entanglement. A typical hydraulic entangling process utilizes high pressure jet streams of water to entangle fibers to form a highly entangled consolidated fibrous structure, e.g., a nonwoven web. Hydraulically entangled nonwoven webs of staple length and continuous fibers are disclosed, for example, in U.S. Pat. No. 3,494,821 to Evans and U.S. Pat. No. 4,144,370 to Boulton, which are incorporated herein in their entirety by reference to the extent they are consistent herewith. Hydraulically entangled composite nonwoven webs of a continuous fiber nonwoven web and a pulp layer are disclosed, for example, in U.S. Pat. No. 5,284,703 to Everhart, et al. and U.S. Pat. No. 6,315,864 to Anderson, et al., which are incorporated herein in their entirety by reference to the extent they are consistent herewith. The fibrous component of the composite may contain any desired amount of the resulting substrate. The fibrous component may contain greater than about 50% by weight of the composite, and in some embodiments, from about 60% to about 90% by weight of the composite. Likewise, the nonwoven web may contain less than about 50% by weight of the composite, and in some embodiments, from about 10% to about 40% by weight of the composite.

Although not required, the nonwoven web material may be necked in one or more directions prior to lamination to the film of the present disclosure. Suitable techniques necking techniques are described in U.S. Pat. Nos. 5,336,545, 5,226,992, 4,981,747 and 4,965,122 to Morman, as well as U.S. Patent Application Publication No. 2004/0121687 to Morman, et al. Alternatively, the nonwoven web may remain relatively inextensible in at least one direction prior to lamination to the film. In such embodiments, the nonwoven web may be optionally stretched in one or more directions subsequent to lamination to the film.

The basis weight of the nonwoven web material may generally vary, such as from about 5 grams per square meter ("gsm") to 120 gsm, in some embodiments from about 10 gsm to about 70 gsm, and in some embodiments, from about 15 gsm to about 35 gsm. When multiple nonwoven web materials, such materials may have the same or different basis weights.

In some embodiments, the width of the strap is selected so that the strap is less prone to roll or shift. For instance, in some embodiments of the disclosure, at least some portion of the strap has a width of from about 0.3 cm to about 5 cm. More suitably, at least some portion of the strap has a width of from about 0.5 cm to about 3 cm and, more suitably a width of from about 2 cm to about 3 cm. In other embodiments, the width of the entire strap is from about 0.3 cm to about 5 cm and, more suitably, the entire strap has a width of from about 0.5 cm to about 3 cm. Even more suitably, the width of the entire strap is about 2.5 cm.

Note also, as depicted in FIGS. 5 through 7, the strap portion may split into two or more bands to facilitate stabilization of the respirator during use. Here the strap portion splits at the user's ear to form, in effect, a sideways Y-shaped strap portion, or Y-shaped junction, with the user's ear proximate to the location at which the strap splits into two bands, one band going under the ear, and one band going over the ear. Further in this regard, the strap over the user's ear may also be located about an upper area of the user's head and the strap under the user's ear may be located about a lower area of the user's head.

Having described the invention in detail, it will be apparent that modifications and variations are possible without departing from the scope of the disclosure defined in the appended claims.

When introducing elements of the present disclosure or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the disclosure are achieved and other advantageous results attained.

As various changes could be made in the above respirators without departing from the scope of the present disclosure, it is intended that all matter contained in the above description and shown in the accompanying drawings shall be interpreted as illustrative and not in a limiting sense.

What is claimed is:

1. A disposable respirator adapted to be placed on a head of a user, the disposable respirator comprising:

a main body made of a non-woven material, the main body being in a pre-formed cupped configuration to cover, in a tight sealing arrangement, a mouth and a nose of the user of the disposable respirator and filter at least a portion of one constituent in air, the main body having a first side of the main body and a second opposing side of the main body;

a first pull-strap fastening component and a second pull-strap fastening component formed separately from the main body, each of the first pull-strap fastening component and the second pull-strap fastening component being formed by molding thermoplastic polymers, the first pull-strap fastening component being attached to the first side of the main body and the second pull-strap fastening component being attached to the second opposing side of the main body;

each of the first pull-strap fastening component and the second pull-strap fastening component comprising a first slot and an associated second slot, each of the first slots being generally parallel to the associated second slot, each of the first pull-strap fastening component and the second pull-strap fastening component having a plurality of integrally formed teeth extending into each of the first slot and the second slot, each of the second slots having a greater number of teeth than each of the first slots, each of the teeth of each of the second slots having pointed ends, each of the teeth of each of the first slots having rounded ends, the teeth extending into each of the first slots being disposed in a direction opposite from the teeth extending into each of the associated second slots, the second slot being located laterally closer to an ear of the user than the first slot; and a strap defined by a closed loop of elastic material, the strap being connected to the first pull-strap fastening component and the second pull-strap fastening component, wherein the second pull-strap fastening component comprises an adjustment means that can be adjusted to fit the disposable respirator to the user's head and the strap is adapted to encircle the user's head by being adjustably looped through the first slot of the first pull-strap fastening component and configured to extend back around the user's head to the second pull-strap fastening component where an overlapped portion of the strap is adjustably threaded through both the first and the second slots of the second pull-strap fastening component, the strap having a width between 2 cm and 3 cm, the strap having a retraction force range of about 30 grams force to about 100 grams force per centimeter in width at 100% elongation after having been extended to 133% elongation, each of the first and the second slots of the first pull-strap fastening component and the second pull-strap fastening component have a width and a length, the width being between 1.0 mm and 1.5 mm as measured from the ends of each of the respective teeth to an opposing side of respective ones of the slots, the length of each of the first and the second slots of the first pull-strap fastening component and the second pull-strap fastening component being between about 25% and about 125% of the width of the strap.

2. The disposable respirator as set forth in claim 1 wherein the strap has a first portion configured to be located over the user's ear and about an upper area of the user's head and a second portion configured to be located under the user's ear and about a lower area of the user's head.

3. The disposable respirator as set forth in claim 1 wherein the first pull-strap and the second pull-strap fastening components further comprise a third slot, and a fourth slot, the first slot being located longitudinally from the third slot, the second slot being located longitudinally from the fourth slot, wherein the second slot and the fourth slot are located laterally closer to the user's ear than the first slot and the third slot.

4. A disposable respirator comprising:

a main body made of a non-woven material, the main body being in a pre-formed cupped configuration to cover, in a tight sealing arrangement, a mouth and a nose of the user of the disposable respirator and filter at least a portion of one constituent in air, the main body having a first side of the main body and a second opposing side of the main body;

a first pull-strap fastening component formed separately from the main body by molding thermoplastic polymers, the first pull-strap fastening component being attached to the first side of the main body, the first pull-strap fastening component having a first slot and an associated second slot generally parallel to the first slot, the second slot being located laterally closer to an ear of the user than the first slot when the disposable respirator is donned by the user;

a second pull-strap fastening component formed separately from the main body by molding thermoplastic polymers, the second pull-strap fastening component being attached to the second side of the main body, the second pull-strap fastening component having a first slot and an associated second slot generally parallel to the first slot, the second slot being located laterally closer to the user's ear than the first slot when the disposable respirator is donned by the user;

each of the first pull-strap fastening component and the second pull-strap fastening component having a plurality of integrally formed teeth extending into the first slot and the second slot, each of the second slots having a greater number of teeth than each of the first slots, each of the teeth of each of the second slots having pointed ends, each of the teeth of each of the first slots having rounded ends, the teeth extending into each of the first slots being disposed in a direction opposite from the teeth extending into each of the associated second slots, a strap defined by a closed loop of elastic material, the strap being adapted to encircle a head of the user when the disposable respirator is donned by the user, the strap being looped through the first slot in the first pull-strap fastening component, an overlapped portion of the strap being threaded through both the first slot and second slot in the second pull-strap fastening component, the strap having a width between 2 cm and 3 cm, the strap having a retraction force range of about 30 grams force to about 100 grams force per centimeter in width at 100% elongation after having been extended to 133% elongation, and each of the first slots and the second slots of the first pull-strap fastening component and the second pull-strap fastening component have a width and a length, the width being between 1.0 mm and 1.5 mm as measured from the ends of each of the respective teeth to an opposing side of respective ones of the slots, the length of each of the first slots and the second slots of the first pull-strap fastening component and the second pull-strap fastening component being about 25% and about 125% of the width of the strap.

5. The disposable respirator as set forth in claim 4 wherein the strap has a width of about 2.5 cm.

6. The disposable respirator as set forth in claim 5 wherein the strap has a first portion configured to be located above the user's ear and about an upper area of the user's head and a second portion configured to be located under the user's ear and about a lower area of the user's head.

7. A disposable respirator comprising:

a main body made of a non-woven material, the main body being in a pre-formed cupped configuration to cover, in a tight sealing arrangement, a mouth and a nose of the user of the disposable respirator and filter at least a portion of one constituent in air, the main body having a first side of the main body and a second opposing side of the main body;

a first pull-strap fastening component formed separately from the main body by molding thermoplastic polymers, the first pull-strap fastening component being attached to the first side of the main body, the first pull-strap fastening component having at least one slot;

a second pull-strap fastening component formed separately from the main body by molding thermoplastic polymers, the second pull-strap fastening component being attached to the second side of the main body, the second pull-strap fastening component having a first slot, an associated second slot and teeth extending into each of the first slot and the second slot, the teeth extending into the first slot being disposed in a direction opposite from the teeth extending into the second slot, the second slot having a greater number of teeth than the first slot; each of the teeth of the second slot having pointed ends, each of the teeth of the first slot having rounded ends, and a strap adapted to encircle a head of the user when the disposable respirator is donned by the user, the strap being defined by a closed loop of elastic material, the strap being looped through the at least one slot in the first pull-strap fastening component and an overlapped portion of the strap being threaded through the first slot and the second slot in the second pull-strap fastening component such that the teeth extending into each of the slots of the second pull-strap fastening component engage the overlapped portion of the strap, wherein the strap has a width between 2 cm and 3 cm, the strap having a retraction force range of about 30 grams force to about 100 grams force per centimeter in width at 100% elongation after having been extended to 133% elongation, and the first slot and the second slots of the second pull-strap fastening component having a width and a length, the width being between 1.0 mm and 1.5 mm as measured from the ends of each of the respective teeth to an opposing side of respective ones of the slots, the length of each of the first and second slots of the second pull-strap fastening component being about 25% and 125% of the width of the strap.

* * * * *